US007517250B2

(12) United States Patent
Hull et al.

(10) Patent No.: US 7,517,250 B2
(45) Date of Patent: Apr. 14, 2009

(54) IMPEDANCE MATING INTERFACE FOR ELECTRICAL CONNECTORS

(75) Inventors: Gregory A. Hull, York, PA (US); Stephen B. Smith, Mechanicsburg, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 10/946,874

(22) Filed: Sep. 22, 2004

(65) Prior Publication Data

US 2005/0148239 A1 Jul. 7, 2005

Related U.S. Application Data

(60) Provisional application No. 60/506,427, filed on Sep. 26, 2003.

(51) Int. Cl.
*H01R 13/648* (2006.01)

(52) U.S. Cl. ..... 439/608

(58) Field of Classification Search ..... 439/608, 439/108, 941, 678, 682
See application file for complete search history.

(56) References Cited

U.S. PATENT DOCUMENTS

| | | | | |
|---|---|---|---|---|
| 3,286,220 | A | 11/1966 | Marley et al. | 439/680 |
| 3,538,486 | A | 11/1970 | Shlesinger, Jr. | 439/268 |
| 3,669,054 | A | 6/1972 | Desso et al. | 113/119 |
| 3,748,633 | A | 7/1973 | Lundergan | 339/217 |
| 4,076,362 | A | 2/1978 | Ichimura | 339/75 |
| 4,159,861 | A | 7/1979 | Anhalt | 339/75 |
| 4,260,212 | A | 4/1981 | Ritchie et al. | 339/97 |
| 4,288,139 | A | 9/1981 | Cobaugh et al. | 339/74 |
| 4,383,724 | A | 5/1983 | Verhoevan | 439/510 |
| 4,402,563 | A | 9/1983 | Sinclair | 339/75 |
| 4,560,222 | A | 12/1985 | Dambach | 339/75 |
| 4,717,360 | A | 1/1988 | Czaja | 439/710 |
| 4,776,803 | A | 10/1988 | Pretchel et al. | 439/59 |
| 4,815,987 | A | 3/1989 | Kawano et al. | 439/263 |
| 4,867,713 | A | 9/1989 | Ozu et al. | 439/833 |
| 4,907,990 | A | 3/1990 | Bertho et al. | 439/851 |

(Continued)

FOREIGN PATENT DOCUMENTS

EP 0 273 683 A2 7/1988

(Continued)

OTHER PUBLICATIONS

Nadolny, J. et al., "Optimizing Connector Selection for Gigabit Signal Speeds", *ECN*™, Sep. 1, 2000, http://www.ecnmag.com/article/CA45245, 6 pages.

(Continued)

*Primary Examiner*—Truc T Nguyen
*Assistant Examiner*—Xuong M Chung-Trans
(74) *Attorney, Agent, or Firm*—Woodcock Washburn LLP

(57) ABSTRACT

Electrical connectors having improved impedance characteristics are disclosed. Such an electrical connector may include a first electrically conductive contact, and a second electrically conductive contact disposed adjacent to the first contact along a first direction. A mating end of the second contact may be staggered in a second direction relative to a mating end of the first contact. Alternatively or additionally, a respective mating end of each of the first and second contacts may be rotated relative to the first direction.

16 Claims, 19 Drawing Sheets

U.S. PATENT DOCUMENTS 4,913,664 A 4/1990 Dixon et al. ..... 439/607
4,973,271 A 11/1990 Ishizuka et al. ..... 439/839
5,066,236 A 11/1991 Broeksteeg ..... 439/79
5,077,893 A 1/1992 Mosquera et al. ..... 29/882
5,163,849 A 11/1992 Fogg et al. ..... 439/497
5,174,770 A * 12/1992 Sasaki et al. ..... 439/108
5,192,231 A 3/1993 Dolin, Jr.
5,238,414 A 8/1993 Yaegashi et al. ..... 439/108
5,254,012 A 10/1993 Wang ..... 439/263
5,274,918 A 1/1994 Reed ..... 29/882
5,277,624 A 1/1994 Champion et al. ..... 439/607
5,286,212 A 2/1994 Broekstagg ..... 439/108
5,302,135 A 4/1994 Lee ..... 439/263
5,342,211 A 8/1994 Broekstagg ..... 439/108
5,356,300 A 10/1994 Costello et al. ..... 439/101
5,356,301 A 10/1994 Champion et al. ..... 439/108
5,357,050 A 10/1994 Baran et al. ..... 174/33
5,431,578 A 7/1995 Wayne ..... 439/259
5,475,922 A 12/1995 Tamura et al. ..... 29/881
5,558,542 A 9/1996 O'Sullivan et al. ..... 439/682
5,586,914 A 12/1996 Foster, Jr. et al. ..... 439/676
5,590,463 A 1/1997 Feldman et al. ..... 29/844
5,609,502 A 3/1997 Thumma ..... 439/747
5,713,746 A 2/1998 Olson et al. ..... 439/79
5,730,609 A 3/1998 Harwath ..... 439/108
5,741,144 A 4/1998 Elco et al. ..... 439/101
5,741,161 A 4/1998 Cahaly et al. ..... 439/709
5,795,191 A 8/1998 Preputnick et al. ..... 439/608
5,817,973 A 10/1998 Elco et al. ..... 174/32
5,853,797 A 12/1998 Fuchs et al. ..... 427/96
5,908,333 A 6/1999 Perino et al. ..... 439/631
5,925,274 A 7/1999 McKinney et al.
5,961,355 A * 10/1999 Morlion et al. ..... 439/686
5,967,844 A 10/1999 Doutrich et al. ..... 439/607
5,971,817 A 10/1999 Longueville ..... 439/857
5,980,321 A 11/1999 Cohen et al. ..... 439/608
5,993,259 A 11/1999 Stokoe et al. ..... 439/608
6,050,862 A 4/2000 Ishii ..... 439/843
6,068,520 A 5/2000 Winings et al. ..... 439/676
6,116,926 A 9/2000 Ortega et al. ..... 439/108
6,116,965 A 9/2000 Arnett et al. ..... 439/692
6,123,554 A 9/2000 Ortega et al. ..... 439/79
6,125,535 A 10/2000 Chiou et al. ..... 29/883
6,129,592 A 10/2000 Mickievicz et al. ..... 439/701
6,139,336 A 10/2000 Olson ..... 439/83
6,146,157 A 11/2000 Lenoir et al. ..... 439/101
6,146,203 A 11/2000 Elco et al. ..... 439/608
6,171,115 B1 1/2001 Mickievicz et al. ..... 439/76.1
6,171,149 B1 1/2001 Van Zanten ..... 439/608
6,190,213 B1 2/2001 Reichart et al. ..... 439/736
6,212,755 B1 4/2001 Shimada et al. ..... 29/527.11
6,219,913 B1 4/2001 Uchiyama ..... 29/883
6,220,896 B1 4/2001 Bertoncici et al. ..... 439/608
6,227,882 B1 5/2001 Ortega et al. ..... 439/101
6,267,604 B1 7/2001 Mickievicz et al. ..... 439/79
6,269,539 B1 8/2001 Takahashi et al. ..... 29/883
6,280,209 B1 8/2001 Bassler et al. ..... 439/101
6,293,827 B1 9/2001 Stokoe et al. ..... 439/608
6,319,075 B1 11/2001 Clark et al. ..... 439/825
6,322,379 B1 11/2001 Ortega et al. ..... 439/108
6,322,393 B1 11/2001 Doutrich et al. ..... 439/607
6,328,602 B1 12/2001 Yamasaki et al. ..... 439/608
6,343,955 B2 2/2002 Billman et al. ..... 439/608
6,347,952 B1 2/2002 Hasegawa et al. ..... 439/608
6,350,134 B1 2/2002 Fogg et al. ..... 439/79
6,354,877 B1 3/2002 Shuey et al. ..... 439/608
6,358,061 B1 3/2002 Regnier ..... 439/60
6,361,366 B1 3/2002 Shuey et al. ..... 439/608
6,363,607 B1 4/2002 Chen et al. ..... 29/883
6,364,710 B1 4/2002 Billman et al. ..... 439/608
6,371,773 B1 * 4/2002 Crofoot et al. ..... 439/79
6,375,478 B1 4/2002 Kikuchi ..... 439/79
6,379,188 B1 4/2002 Cohen et al. ..... 439/608
6,386,914 B1 5/2002 Collins et al. ..... 439/579
6,409,543 B1 6/2002 Astbury, Jr. et al. ..... 439/608
6,431,914 B1 8/2002 Billman ..... 439/608
6,435,914 B1 8/2002 Billman ..... 439/608
6,461,202 B2 10/2002 Kline ..... 439/701
6,471,548 B2 10/2002 Bertoncini et al. ..... 439/608
6,482,038 B2 11/2002 Olson ..... 439/608
6,485,330 B1 11/2002 Doutrich ..... 439/572
6,506,081 B2 1/2003 Blanchfield et al. ..... 439/682
6,520,803 B1 2/2003 Dunn ..... 439/608
6,527,587 B1 3/2003 Ortega et al. ..... 439/608
6,537,111 B2 3/2003 Brammer et al. ..... 439/857
6,540,559 B1 4/2003 Kemmick et al. ..... 439/608
6,547,066 B2 4/2003 Koch ..... 206/308.1
6,554,647 B1 4/2003 Cohen et al. ..... 439/607
6,572,410 B1 6/2003 Volstorf et al. ..... 439/608
6,652,318 B1 11/2003 Winings et al. ..... 439/608
6,672,907 B2 * 1/2004 Azuma ..... 439/682
6,692,272 B2 2/2004 Lemke et al. ..... 439/108
6,695,627 B2 2/2004 Ortega et al. ..... 439/78
6,762,067 B1 7/2004 Quinones et al.
6,764,341 B2 * 7/2004 Lappoehn ..... 439/608
6,776,649 B2 8/2004 Pape et al. ..... 439/485
6,805,278 B1 10/2004 Olson et al.
6,808,399 B2 10/2004 Rothermel et al. ..... 439/108
6,824,391 B2 11/2004 Mickievicz et al.
6,848,944 B2 2/2005 Evans ..... 439/608
6,851,974 B2 2/2005 Doutrich ..... 439/572
6,852,567 B1 2/2005 Lee et al.
6,890,214 B2 5/2005 Brown et al. ..... 439/608
6,913,490 B2 7/2005 Whiteman, Jr. et al. ..... 439/608
6,932,649 B1 8/2005 Rothermel et al. ..... 439/620
6,945,796 B2 9/2005 Bassler et al. ..... 439/101
6,953,351 B2 10/2005 Fromm et al. ..... 439/101
6,969,280 B2 11/2005 Chien et al. ..... 439/608
6,976,886 B2 12/2005 Winings et al.
6,994,569 B2 2/2006 Minich et al.
7,097,506 B2 8/2006 Nakada ..... 439/608
7,118,391 B2 10/2006 Minich et al.
7,131,870 B2 11/2006 Whiteman, Jr. et al.
2002/0106930 A1 8/2002 Pape et al. ..... 439/485
2003/0143894 A1 7/2003 Kline et al. ..... 439/608
2003/0220021 A1 11/2003 Whiteman, Jr. et al. ..... 439/608
2005/0009402 A1 1/2005 Chien et al. ..... 439/608
2005/0118869 A1 6/2005 Evans ..... 439/608
2006/0014433 A1 1/2006 Consoli et al. ..... 439/608
2006/0046526 A1 3/2006 Minich
2006/0192274 A1 8/2006 Lee et al.

FOREIGN PATENT DOCUMENTS

EP 0 891 016 10/2002
EP 1 148 587 B1 4/2005
JP 06-236788 8/1994
JP 07-114958 5/1995
JP 11-185 886 7/1999
JP 2000-003743 1/2000
JP 2000-003744 1/2000
JP 2000-003745 1/2000
JP 2000-003746 1/2000
WO WO 01/29931 A1 4/2001
WO WO 01/39332 A1 5/2001
WO WO 2006031296 A2 3/2006

OTHER PUBLICATIONS

"PCB-Mounted Receptacle Assemblies, 2.00 mm(0.079in) Centerlines, Right-Angle Solder-to-Board Signal Receptacle", *Metral*™, Berg Electronics, 10-6-10-7.
Metral™ "Speed and Density Extensions", FCI, Jun. 3, 1999, 25 pages.
Framatome Connector Specification, 1 page.

Millipacs Connector Type A Specification, 1 page.
Fusi, M.A. et al., "Differential Signal Transmission through Backplanes and Connectors", *Electronic Packaging and Production*, Mar. 1996, 27-31.
Goel, R.P. et al., "AMP Z-Pack Interconnect System", 1990, AMP Incorporated, 9 pages.
"FCI's Airmax VS® Connector System Honored at DesignCon", 2005, Heilind Electronics, Inc., http://www.heilind.com/products/fci/airmax-vs-design.asp, 1 page.
Hult, B., "FCI's Problem Solving Approach Changes Market, The FCI Electronics AirMax VS®", *ConnectorSupplier,com*, Http://www.connectorsupplier.com/tech_updates_FCI-Airmax_archive.htm, 2006, 4 pages.
Backplane Products Overview Page, http://www.molex.com/cgi-bin/bv/molex/super_family/super_family.jsp?BV_Session ID+@, 2005-2006 © Molex, 4 pages.
AMP Z-Pack 2mm HM Interconnection System, 1992 and 1994 © by AMP Incorporated, 6 pages.
Metral® 2mm High-Speed Connectors, 1000, 2000, 3000 Series, Electrical Performance Data for Differential Applications, FCI Framatome Group, 2 pages.
HDM® HDM Plus® Connectors, http://www.teradyne.com/prods/tcs/products/connectors/backplane/hdm/index.html, 2006, 1 page.
Amphenol TCS (ATCS):HDM® Stacker Signal Integrity, http://www.teradyne.com/prods/tcs/products/connectors/merzzanine/hdm_stacker/signintegr, 3 pages.
Amphenol TCS (ATCS): VHDM Connector, http://www.teradyne.com/prods/tcs/products/connectors/backplane/vhdm/index.html, 2 pages.
VHDM High-Speed Differential (VHDM HSD), http://www.teradyne.com/prods/bps/vhdm/hsd.html. 6 pages.
Amphenol TCS(ATCS): VHDM L-Series Connector, http://www.teradyne.com/prods/tcs/products/connectors/backplane/vhdm_1-series/index.html, 2006, 4 pages.
VHDM Daughterboard Connectors Feature press-fit Terminations and a Non-Stubbing Seperable Interface, ® Teradyne, Inc. Connections Systems Division, Oct. 8, 1997, 46 pages.
HDM/HDM *plus*, 2mm Backplane Interconnection System, Teradyne Connection Systems, © 1993, 22 pages.
HDM Separable Interface Detail, Molex®, 3 pages.
"Lucent Technologies' Bell Labs and FCI Demonstrate 25gb/S Data Transmission over Electrical Backplane Connectors", Feb. 1, 2005, http://www.lucnet.com/press/0205/050201.bla.html, 4 pages.
"B.? Bandwidth and Rise Time Budgets", Module 1-8. Fiber Optic Telecommunications (E-XVI-2a), http://cord.org/step_online/st1-8/st18exvi2a.htm, 3 pages.
"Tyco Electronics, Z-Dok and Connector",Tyco Electronics, Jun. 23, 2003, http://2dok.tyco.elcetronics.com, 15 pages.
Tyco Electronics/AMP, "Z-Dok and Z-Dok and Connectors", Application Specification # 114-13068, Aug. 30, 2005, Revision A, 16 pages.
Tyco Electronics, "Champ Z-Dok Connector System",Catalog # 1309281, Issued Jan. 2002, 3 pages.
*Gig-Array ® High Speed Mezzanine Connectors 15-40 mm Board to Board*, Jun. 5, 2006, 1 page.
*Communications, Data, Consumer Division Mezzanine High-Speed High-Density Connectors Gig-Array® and Meg-Array® electrical. Performance Data*, 10 pages FCI Corporation.
AMP Z-Pack 2mm HM Connector, 2mm Centerline, Eight-Row, Right-Angle Applications, Electrical Performance Report, EPR 889065, Issued Sep. 1998, 59 pages.
AMP Z-Pack HM-Zd Performance at Gigabit Speeds, Tyco Electronics, Report #20GC014, Rev.B., May 4, 2001, 30 pages.
4.0 UHD Connector: Differential Signal Crosstalk, Reflections, 1998, p. 8-9.

* cited by examiner

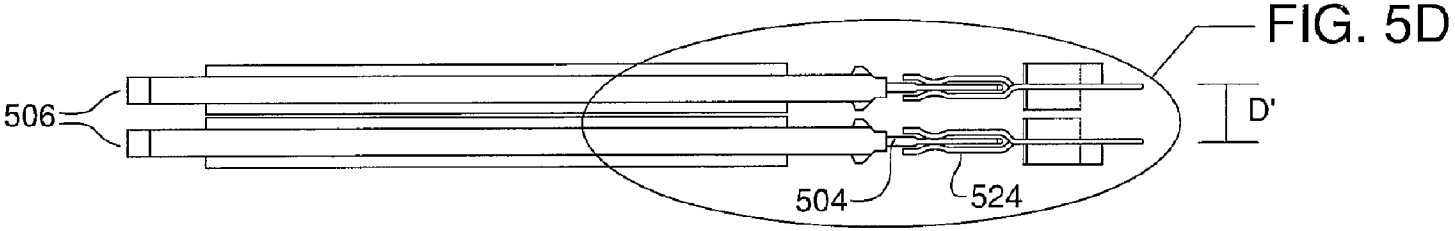
FIG. 5D
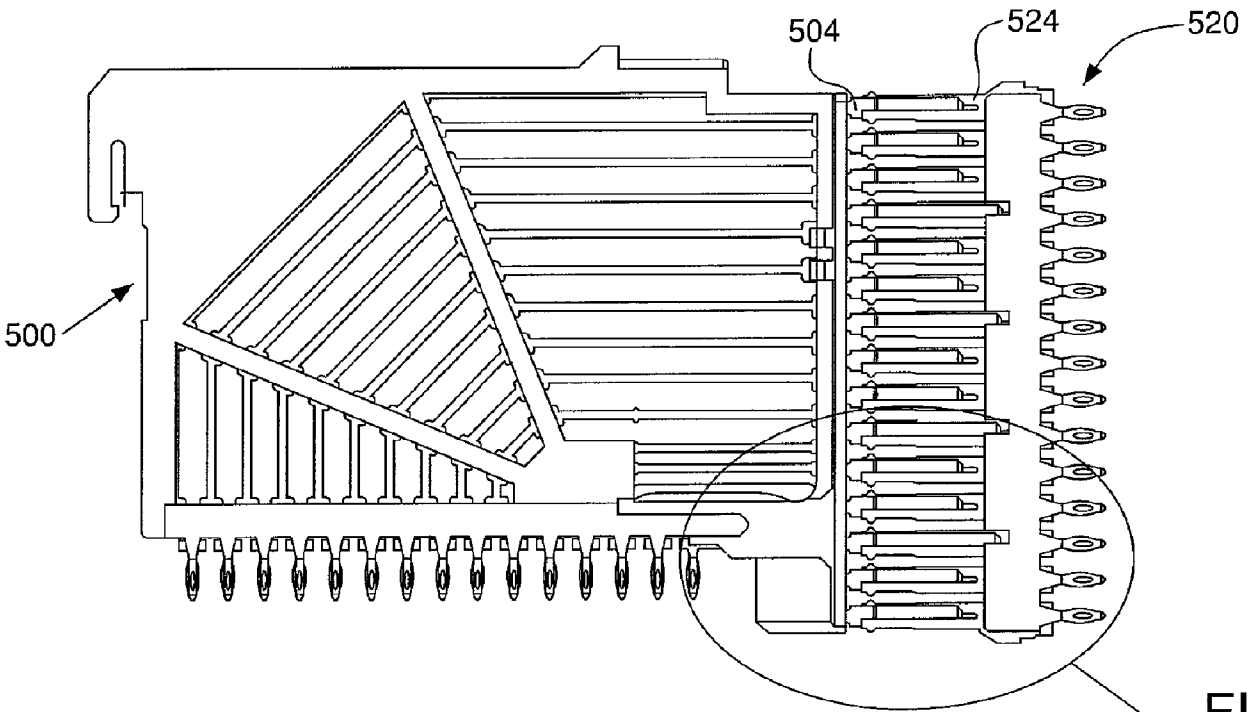
FIG. 5C
FIG. 5B
FIG. 5A

IMPEDANCE MATING INTERFACE FOR ELECTRICAL CONNECTORS

CROSS-REFERENCE TO RELATED APPLICATIONS

This application claims benefit under 35 U.S.C. § 119(e) of provisional U.S. patent application No. 60/506,427, filed Sep. 26, 2003, entitled "Improved Impedance Mating Interface For Electrical Connectors."

The subject matter disclosed herein is related to the subject matter disclosed and claimed in U.S. patent application Ser. No. 10/634,547, filed Aug. 5, 2003, entitled "Electrical connectors having contacts that may be selectively designated as either signal or ground contacts," and in U.S. patent application Ser. No. 10/294,966, filed Nov. 14, 2002, which is a continuation-in-part of U.S. patent applications Ser. No. 09/990,794, filed Nov. 14, 2001, now U.S. Pat. No. 6,692,272, and Ser. No. 10/155,786, filed May 24, 2002, now U.S. Pat. No. 6,652,318. The disclosure of each of the above-referenced U.S. patents and patent applications is herein incorporated by reference in its entirety.

FIELD OF THE INVENTION

Generally, the invention relates to electrical connectors. More particularly, the invention relates to improved impedance interfaces for electrical connectors.

BACKGROUND OF THE INVENTION

Electrical connectors can experience an impedance drop near the mating interface area of the connector. A side view of an example embodiment of an electrical connector is shown in FIG. 1A. The mating interface area is designated generally with the reference I and refers to the mating interface between the header connector H and the receptacle connector R.

FIG. 1B illustrates the impedance drop in the mating interface area. FIG. 1B is a reflection plot of differential impedance as a function of signal propagation time through a selected differential signal pair within a connector as shown in FIG. 1A. Differential impedance was measured at various times as the signal propagated through a first test board, a receptacle connector (such as described in detail below) and associated receptacle vias, the interface between the header connector and the receptacle connector, a header connector (such as described in detail below) and associated header vias, and a second test board. Differential impedance was measured for a 40 ps rise time from 10%-90% of voltage level.

As shown, the differential impedance is about 100 ohms throughout most of the signal path. At the interface between the header connector and receptacle connector, however, there is a drop from the nominal standard of approximately 100 Ω, to an impedance of about 93/94 Ω. Though the data shown in the plot of FIG. 1B is within acceptable standards (because the drop is within ±8 Ω of the nominal impedance), there is room for improvement.

Additionally, there may be times when matching the impedance in a connector with the impedance of a device is necessary to prevent signal reflection, a problem generally magnified at higher data rates. Such matching may benefit from a slight reduction or increase in the impedance of a connector. Such fine-tuning of impedance in a conductor is a difficult task, usually requiring a change in the form or amount of dielectric material of the connector housing.

Therefore, there is also a need for an electrical connector that provides for fine-tuning of connector impedance.

SUMMARY OF THE INVENTION

The invention provides for improved performance by adjusting impedance in the mating interface area. Such an improvement may be realized by moving and/or rotating the contacts in or out of alignment. Impedance may be minimized (and capacitance maximized) by aligning the edges of the contacts. Lowering capacitance, by moving the contacts out of alignment, for example, increases impedance. The invention provides an approach for adjusting impedance, in a controlled manner, to a target impedance level. Thus, the invention provides for improved data flow through high-speed (e.g., >10 Gb/s) connectors.

BRIEF DESCRIPTION OF THE DRAWINGS

FIGS. 5A-D depict engaged blade and receptacle contacts in a connector system.

DETAILED DESCRIPTION OF ILLUSTRATIVE EMBODIMENTS

Figure 2A:
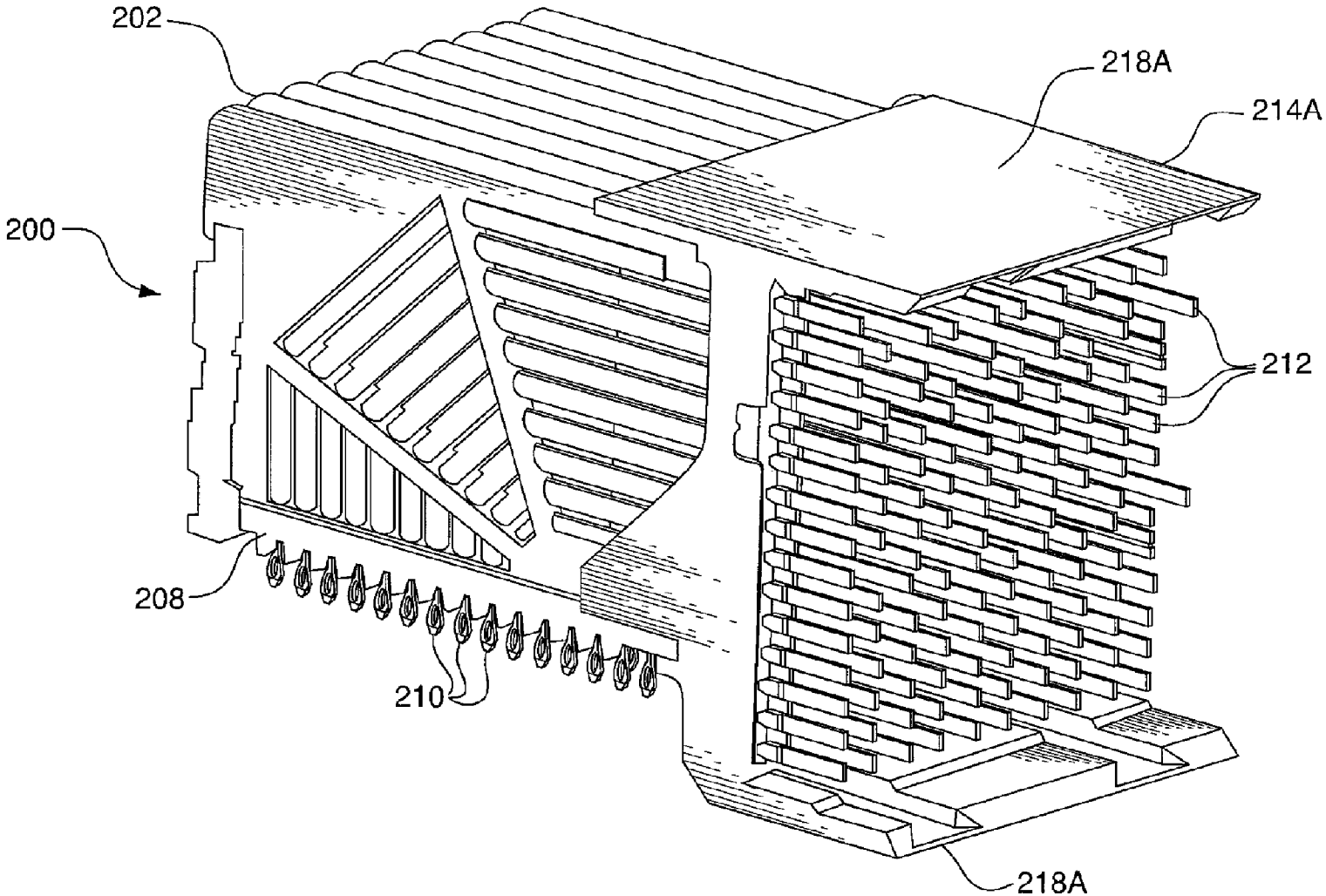
FIGS. 2A and 2B depict example embodiments of a header connector.
Figure 2B:
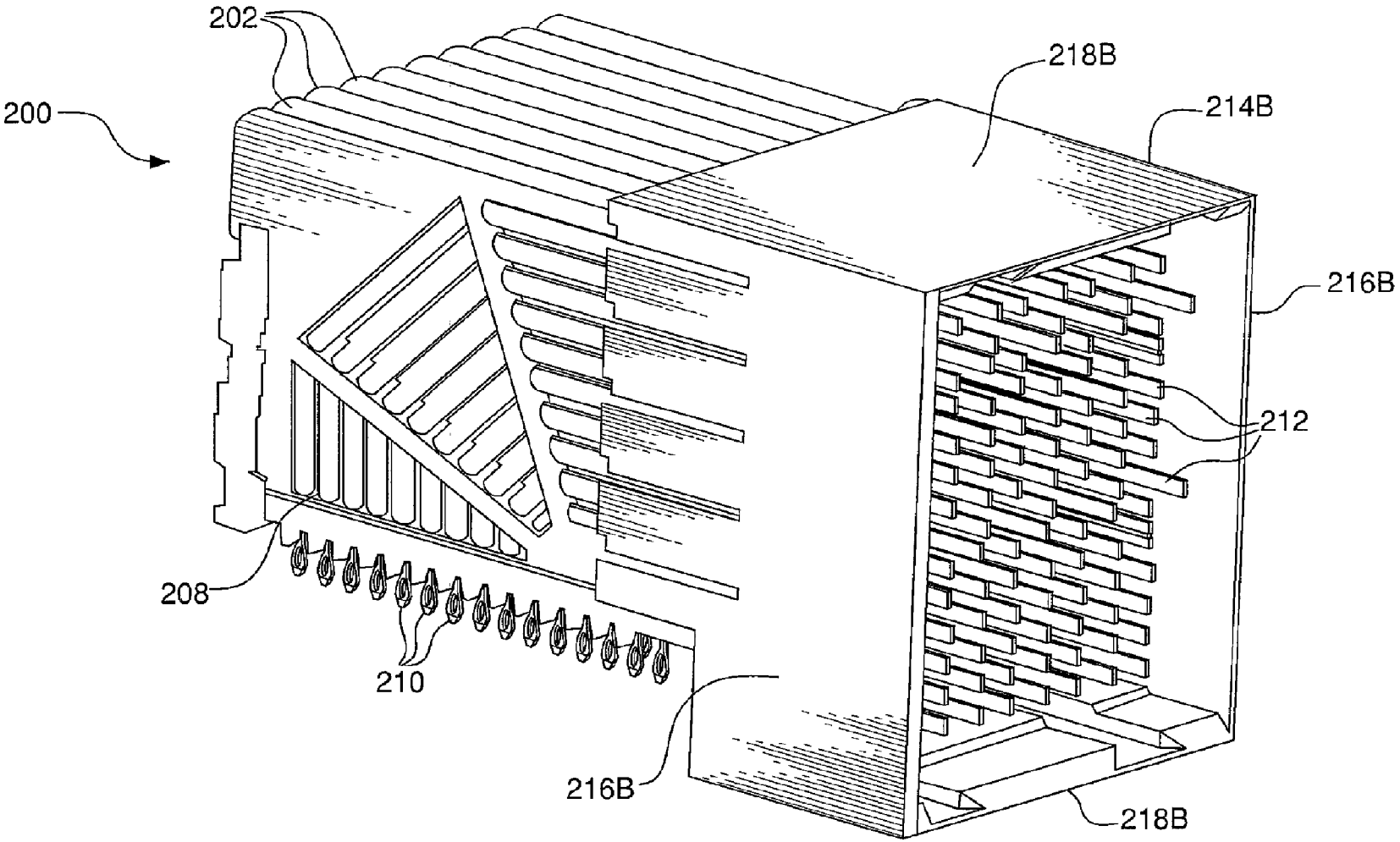
Figure 3A:
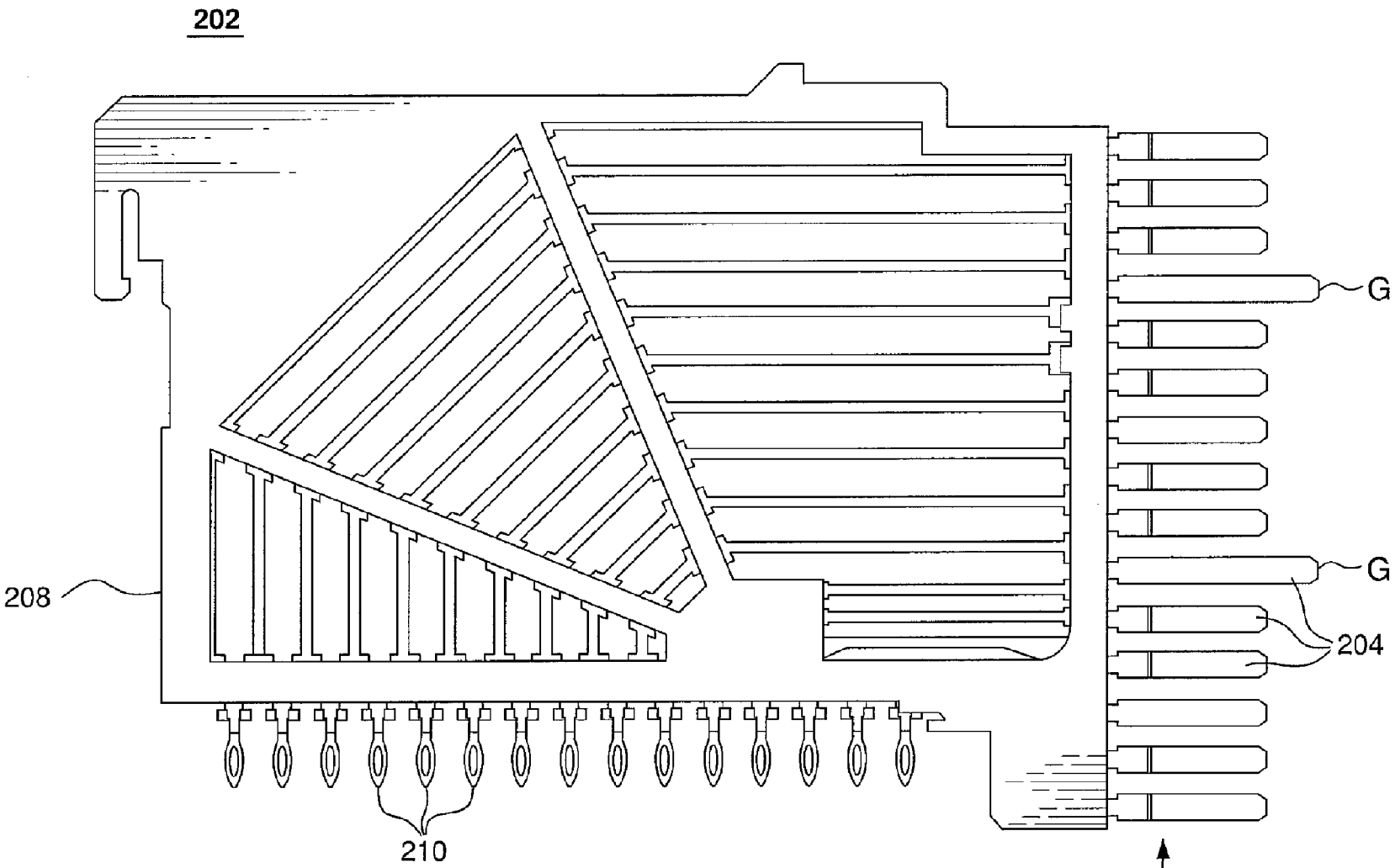
FIGS. 3A and 3B are side views of example embodiments of an insert molded leadframe assembly (IMLA).
Figure 3B:
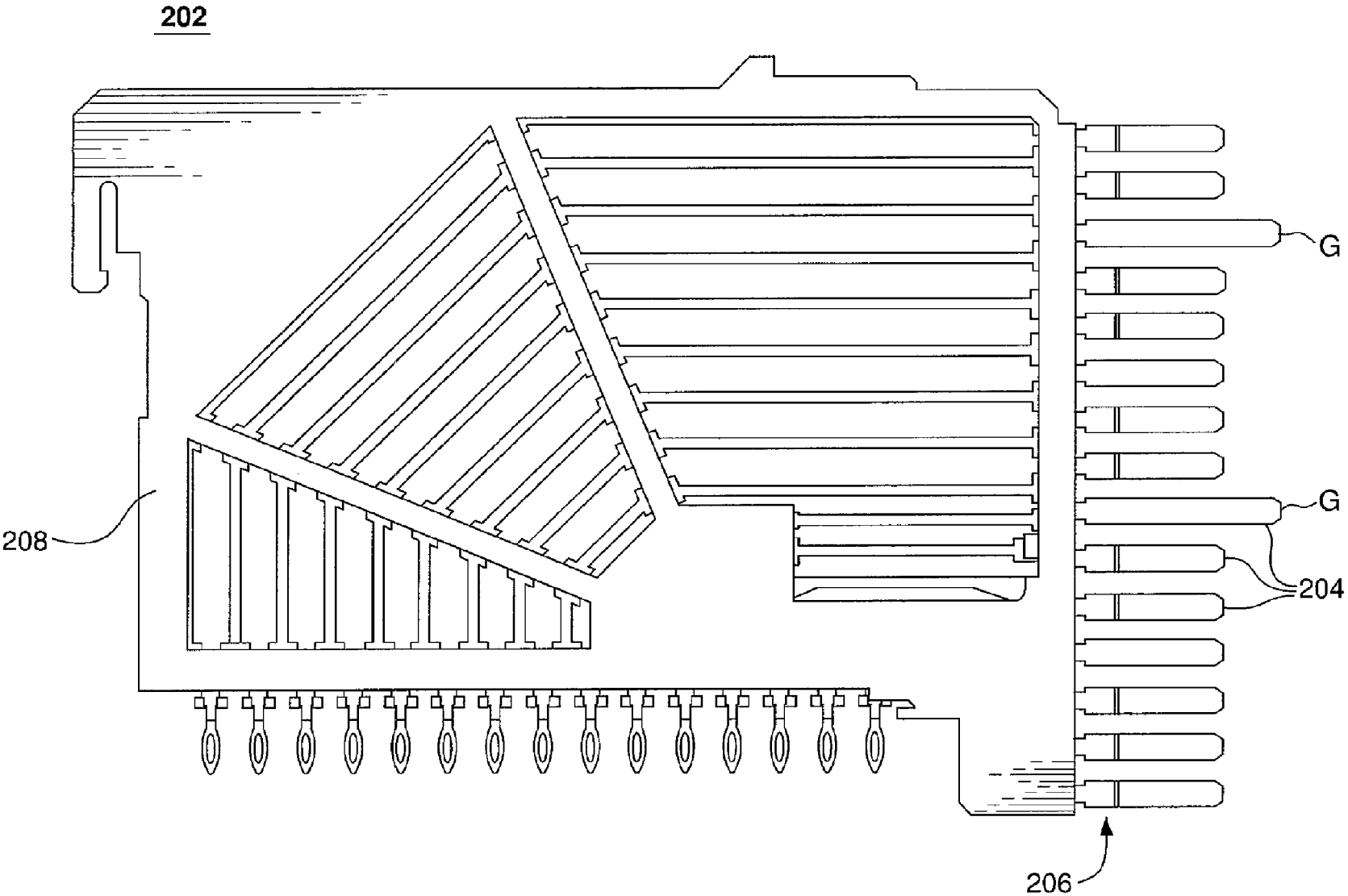

FIGS. 2A and 2B depict example embodiments of a header connector. As shown, the header connector 200 may include a plurality of insert molded leadframe assemblies (IMLAs) 202. FIGS. 3A and 3B are side views of example embodiments of an IMLA 202 according to the invention. An IMLA 202 includes a contact set 206 of electrically conductive contacts 204, and an IMLA frame 208 through which the contacts 204 at least partially extend. An IMLA 202 may be used, without modification, for single-ended signaling, differential signaling, or a combination of single-ended signaling and differential signaling. Each contact 204 may be selectively designated as a ground contact, a single-ended signal conductor, or one of a differential signal pair of signal conductors. The contacts designated G may be ground contacts, the terminal ends of which may be extended beyond the terminal ends of the other contacts. Thus, the ground contacts G may mate with complementary receptacle contacts before any of the signal contacts mates.

As shown, the IMLAs are arranged such that contact sets 206 form contact columns, though it should be understood that the IMLAs could be arranged such that the contact sets are contact rows. Also, though the header connector 200 is depicted with 150 contacts (i.e., 10 IMLAs with 15 contacts per IMLA), it should be understood that an IMLA may include any desired number of contacts and a connector may include any number of IMLAs. For example, IMLAs having 12 or 9 electrical contacts are also contemplated. A connector according to the invention, therefore, may include any number of contacts.

The header connector 200 includes an electrically insulating IMLA frame 208 through which the contacts extend. Preferably, each IMLA frame 208 is made of a dielectric material such as a plastic. According to an aspect of the invention, the IMLA frame 208 is constructed from as little material as possible. Otherwise, the connector is air-filled. That is, the contacts may be insulated from one another using air as a second dielectric. The use of air provides for a decrease in crosstalk and for a low-weight connector (as compared to a connector that uses a heavier dielectric material throughout).

The contacts 204 include terminal ends 210 for engagement with a circuit board. Preferably, the terminal ends are compliant terminal ends, though it should be understood that the terminals ends could be press-fit or any surface-mount or through-mount terminal ends. The contacts also include mating ends 212 for engagement with complementary receptacle contacts (described below in connection with FIGS. 4A and 4B).

As shown in FIG. 2A, a housing 214A is preferred. The housing 214A includes first and second walls 218A. FIG. 2B depicts a header connector with a housing 214B that includes a first pair of end walls 216B and a second pair of walls 218B.

The header connector may be devoid of any internal shielding. That is, the header connector may be devoid of any shield plates, for example, between adjacent contact sets. A connector according to the invention may be devoid of such internal shielding even for high-speed, high-frequency, fast rise-time signaling.

Though the header connector 200 depicted in FIGS. 2A and 2B is shown as a right-angle connector, it should be understood that a connector according to the invention may be any style connector, such as a mezzanine connector, for example. That is, an appropriate header connector may be designed according to the principles of the invention for any type connector.

Figure 4A:
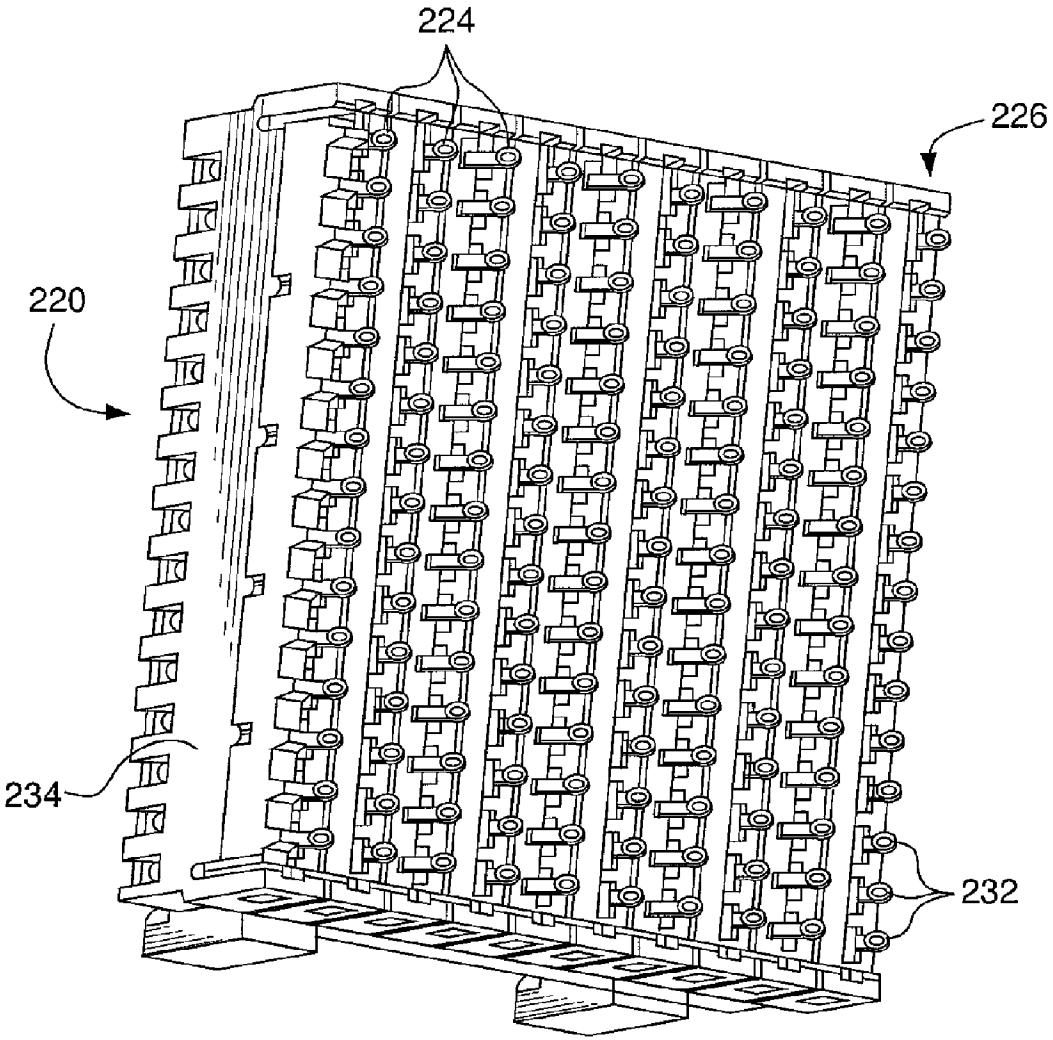
FIGS. 4A and 4B depict an example embodiment of a receptacle connector.
Figure 4B:
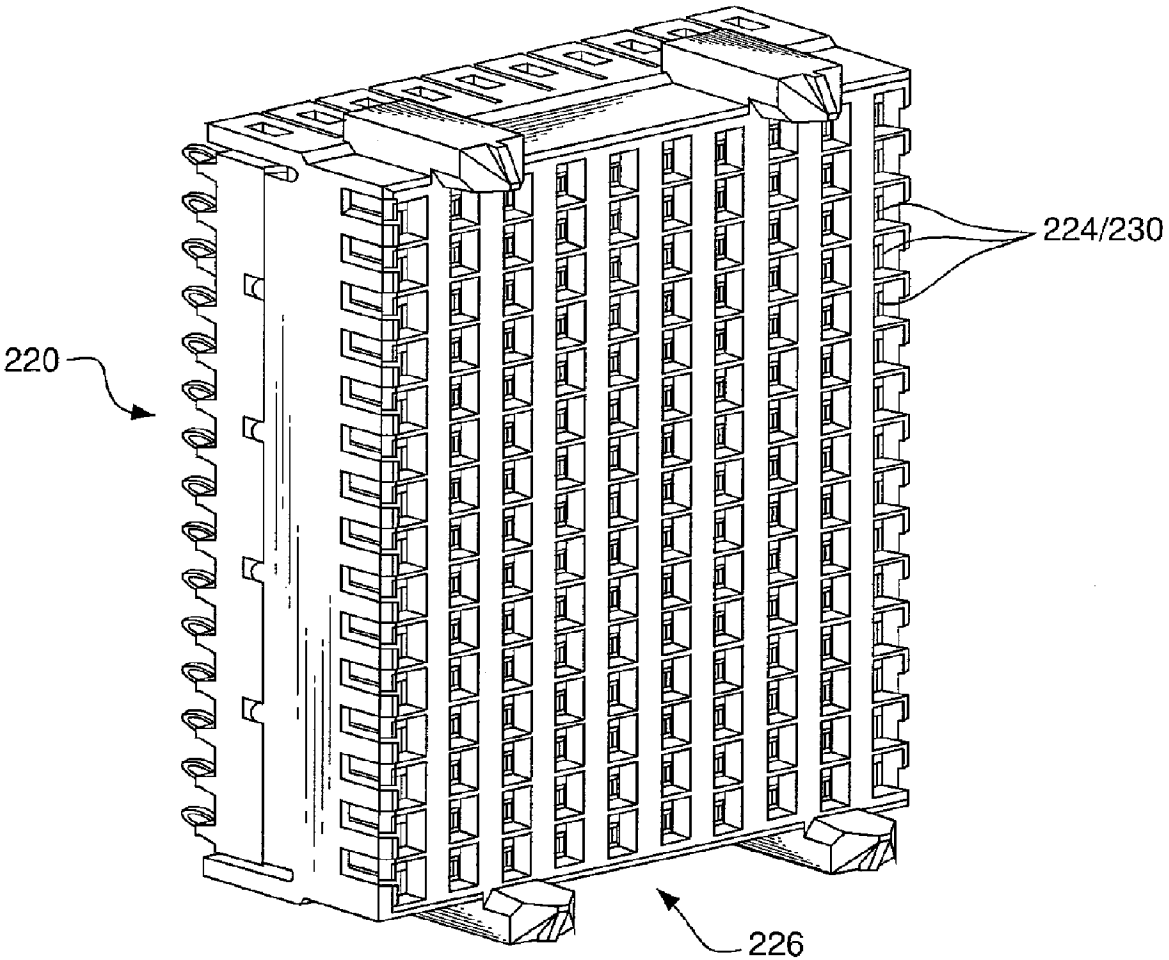

FIGS. 4A and 4B depict an example embodiment of a receptacle connector 220. The receptacle connector 220 includes a plurality of receptacle contacts 224, each of which is adapted to receive a respective mating end 212. Further, the receptacle contacts 224 are in an arrangement that is complementary to the arrangement of the mating ends 212. Thus, the mating ends 212 may be received by the receptacle contacts 224 upon mating of the assemblies. Preferably, to complement the arrangement of the mating ends 212, the receptacle contacts 224 are arranged to form contact sets 226. Again, though the receptacle connector 220 is depicted with 150 contacts (i.e., 15 contacts per column), it should be understood that a connector according to the invention may include any number of contacts.

Each receptacle contact 224 has a mating end 230, for receiving a mating end 212 of a complementary header contact 204, and a terminal end 232 for engagement with a circuit board. Preferably, the terminal ends 232 are compliant terminal ends, though it should be understood that the terminals ends could be press-fit, balls, or any surface-mount or through-mount terminal ends. A housing 234 is also preferably provided to position and retain the IMLAs relative to one another.

According to an aspect of the invention, the receptacle connector may also be devoid of any internal shielding. That is, the receptacle connector may be devoid of any shield plates, for example, between adjacent contact sets.

Figure 5B:
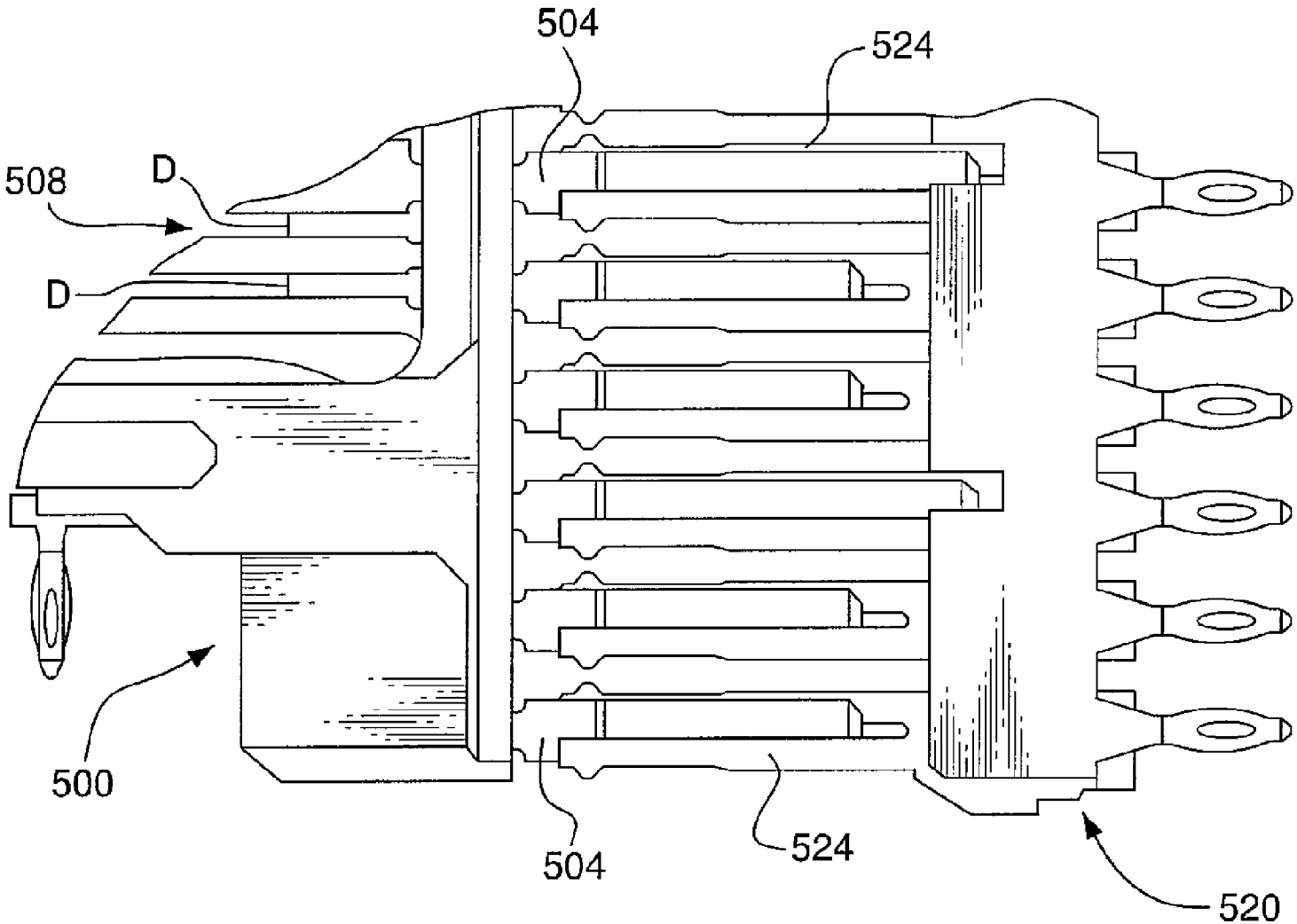

FIGS. 5A-D depict engaged blade and receptacle contacts in a connector system. FIG. 5A is a side view of a mated connector system including engaged blade contacts 504 and receptacle contacts 524. As shown in FIG. 5A, the connector system may include a header connector 500 that includes one or more blade contacts 504, and a receptacle connector 520 that includes one or more receptacle contacts 524.

FIG. 5B is a partial, detailed view of the connector system shown in FIG. 5A. Each of a plurality of blade contacts 504 may engage a respective one of a plurality of receptacle contacts 524. As shown, blade contacts 504 may be disposed along, and extend through, an IMLA in the header connector 500. Receptacle contacts 524 may be disposed along, and extend through, an IMLA in the receptacle connector 520. Contacts 504 may extend through respective air regions 508 and be separated from one another in the air region 508 by a distance D.

Figure 5D:
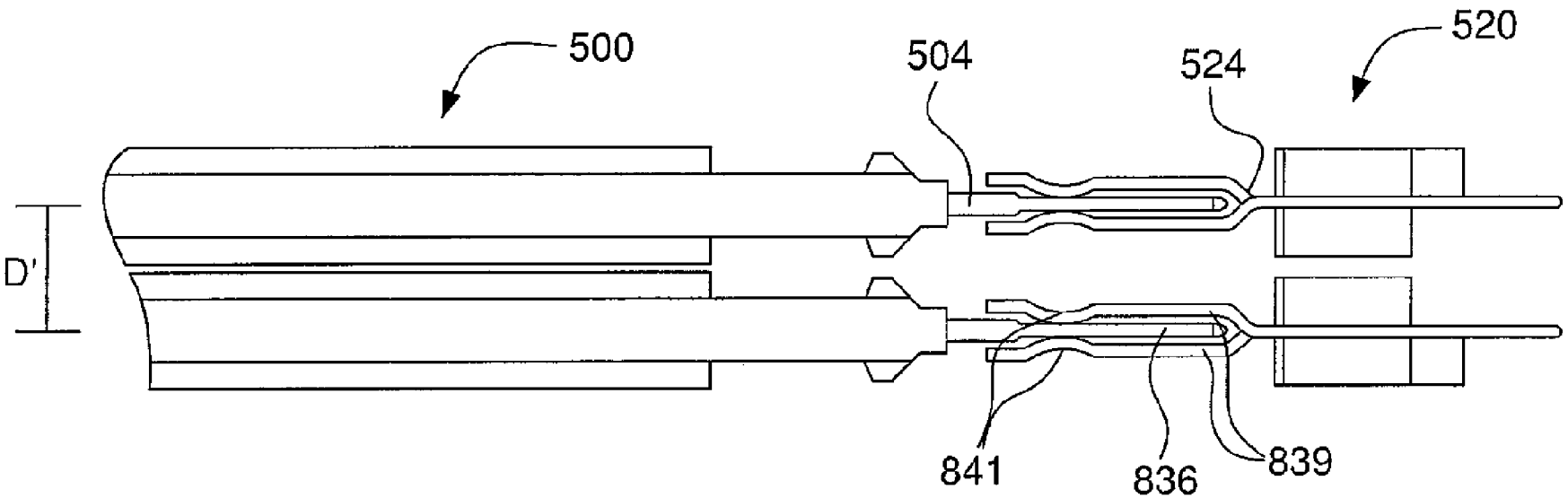

FIG. 5C is a partial top view of engaged blade and receptacle contacts in adjacent IMLAs. FIG. 5D is a partial detail view of the engaged blade and receptacle contacts shown in FIG. 5C. Either or both of the contacts may be signal contacts or ground contacts, and the pair of contacts may form a differential signal pair. Either or both of the contacts may be single-ended signal conductors.

Each blade contact 504 extends through a respective IMLA 506. Contacts 504 in adjacent IMLAs may be separated from one another by a distance D'. Blade contacts 504 may be received in respective receptacle contacts 524 to provide electrical connection between the blade contacts 504 and respective receptacle contacts 524. As shown, a terminal portion 836 of blade contact 504 may be received by a pair of beam portions 839 of a receptacle contact 524. Each beam portion 839 may include a contact interface portion 841 that makes electrical contact with the terminal portion 836 of the blade contact 504. Preferably, the beam portions 839 are sized and shaped to provide contact between the blades 836 and the contact interfaces 841 over a combined surface area that is sufficient to maintain the electrical characteristics of the connector during mating and unmating of the connector.

Figure 6:
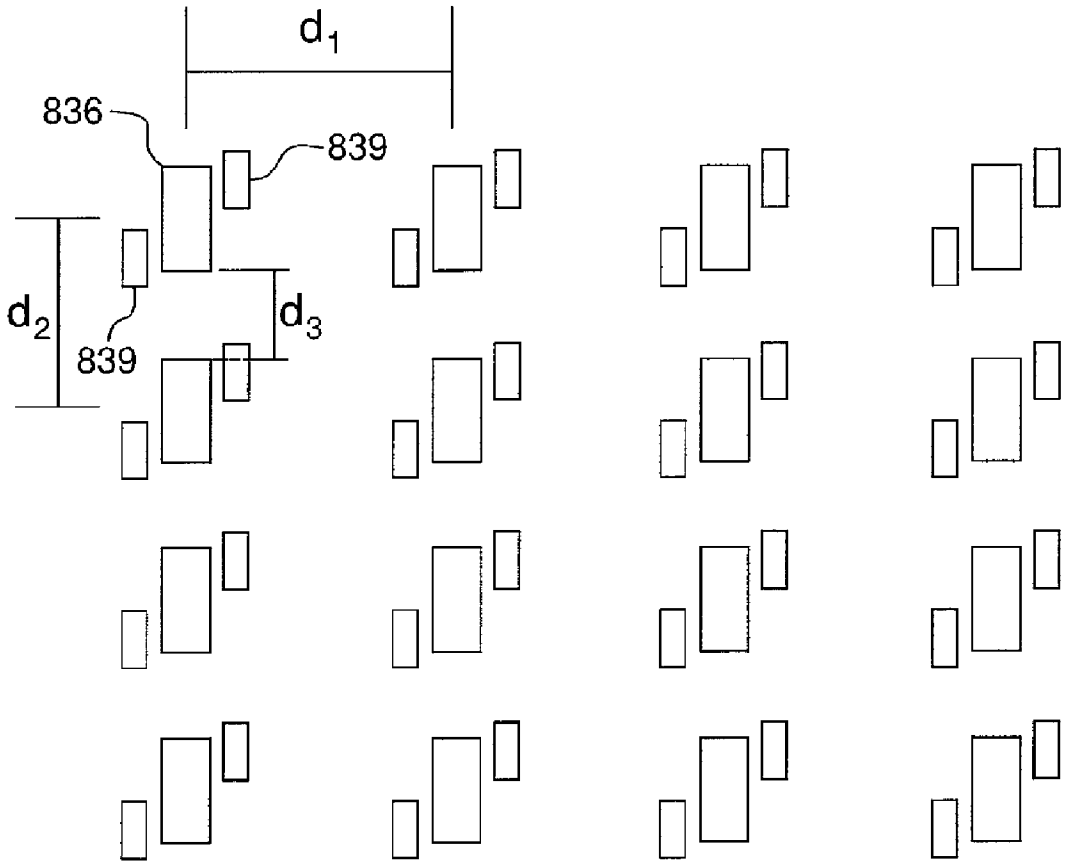
FIG. 6 (Prior Art)
FIG. 6 depicts a cross-sectional view of a contact configuration for known connectors, such as the connector shown in FIGS. 5A-5D.

FIG. 6 depicts a cross-sectional view of a contact configuration for known connectors, such as the connector shown in FIGS. 5A-5D. As shown, terminal blades 836 of the blade contacts are received into beam portions 839 of the receptacle contacts. The contact configuration shown in FIG. 6 allows the edge-coupled aspect ratio to be maintained in the mating region. That is, the aspect ratio of column pitch to gap width may be chosen to limit cross talk in the connector exists in the contact region as well, and thereby limits cross talk in the mating region. Also, because the cross-section of the unmated blade contact is nearly the same as the combined cross-section of the mated contacts, the impedance profile can be maintained even if the connector is partially unmated. This occurs, at least in part, because the combined cross-section of the mated contacts includes no more than one or two thickness of metal (the thicknesses of the blade and the contact interface), rather than three thicknesses as would be typical in prior art connectors. In such prior art connectors, mating or unmating results in a significant change in cross-section, and therefore, a significant change in impedance (which may cause significant degradation of electrical performance if the connector is not properly and completely mated). Because the contact cross-section does not change dramatically as the connector is unmated, the connector can provide nearly the same electrical characteristics when partially unmated (e.g., unmated by about 1-2 mm) as it does when fully mated.

As shown in FIG. 6, the contacts are arranged in contact columns set a distance $d_1$ apart. Thus, the column pitch (i.e., distance between adjacent contact columns) is $d_1$. Similarly, the distance between the contact centers of adjacent contacts in a given row is also $d_1$. The row pitch (i.e., distance between adjacent contact rows) is $d_2$. Similarly, the distance between the contact centers of adjacent contacts in a given column is $d_2$. Note the edge-coupling of adjacent contacts along each contact column. As shown in FIG. 6, $d_1$ may be approximately 12 mm and $d_2$ may be approximately 8.4 mm, though those skilled in the art of electrical connectors will understand that $d_1$ and $d_2$ may be any appropriate distance. The differential impedance for the contact configuration of FIG. 6 may be approximately 109.0 Ω.

Figure 7:
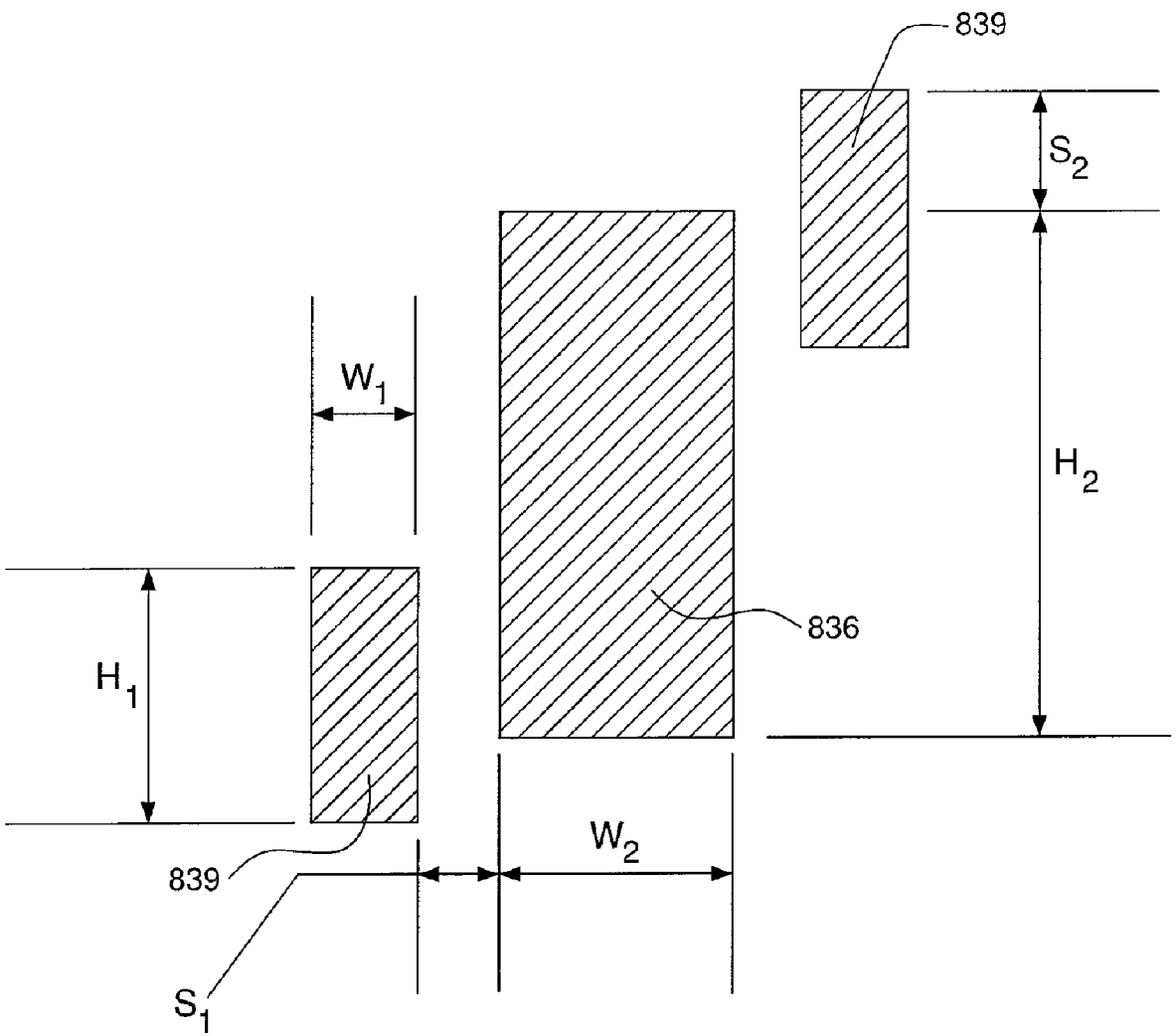
FIG. 7 (Prior Art)
FIG. 7 is a cross-sectional view of a blade contact engaged in a receptacle contact.

FIG. 7 is a detailed cross-sectional view of a blade contact 836 engaged in a receptacle contact 841 in a configuration as depicted in FIG. 6. In an example embodiment, the width $W_2$ and height $H_2$ of terminal blade 836 may be approximately 2.1 mm and 4.5 mm, respectively. The width $W_1$ and height $H_1$ of contact interfaces 841 may be approximately 1.14 mm and 2.47 mm, respectively. The spacing $S_1$ between contact interfaces 841 and terminal blade 836 may be approximately 0.65 mm. Contact interfaces 841 are offset from terminal blade 836 by a distance $S_2$, which may be approximately 0.77 mm, for example.

Figure 1A:
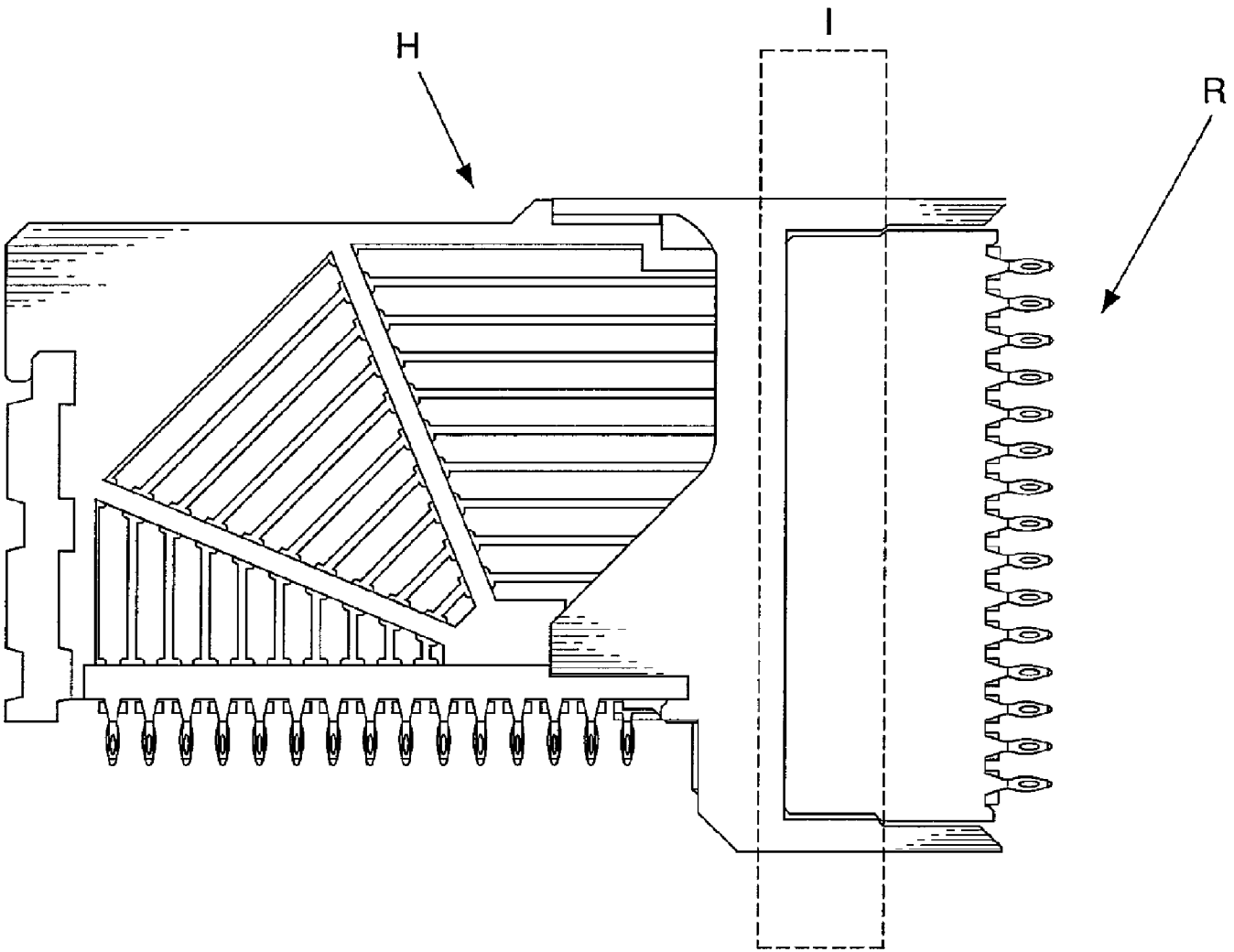
FIG. 1A is a side view of a typical electrical connector.
Figure 1B:
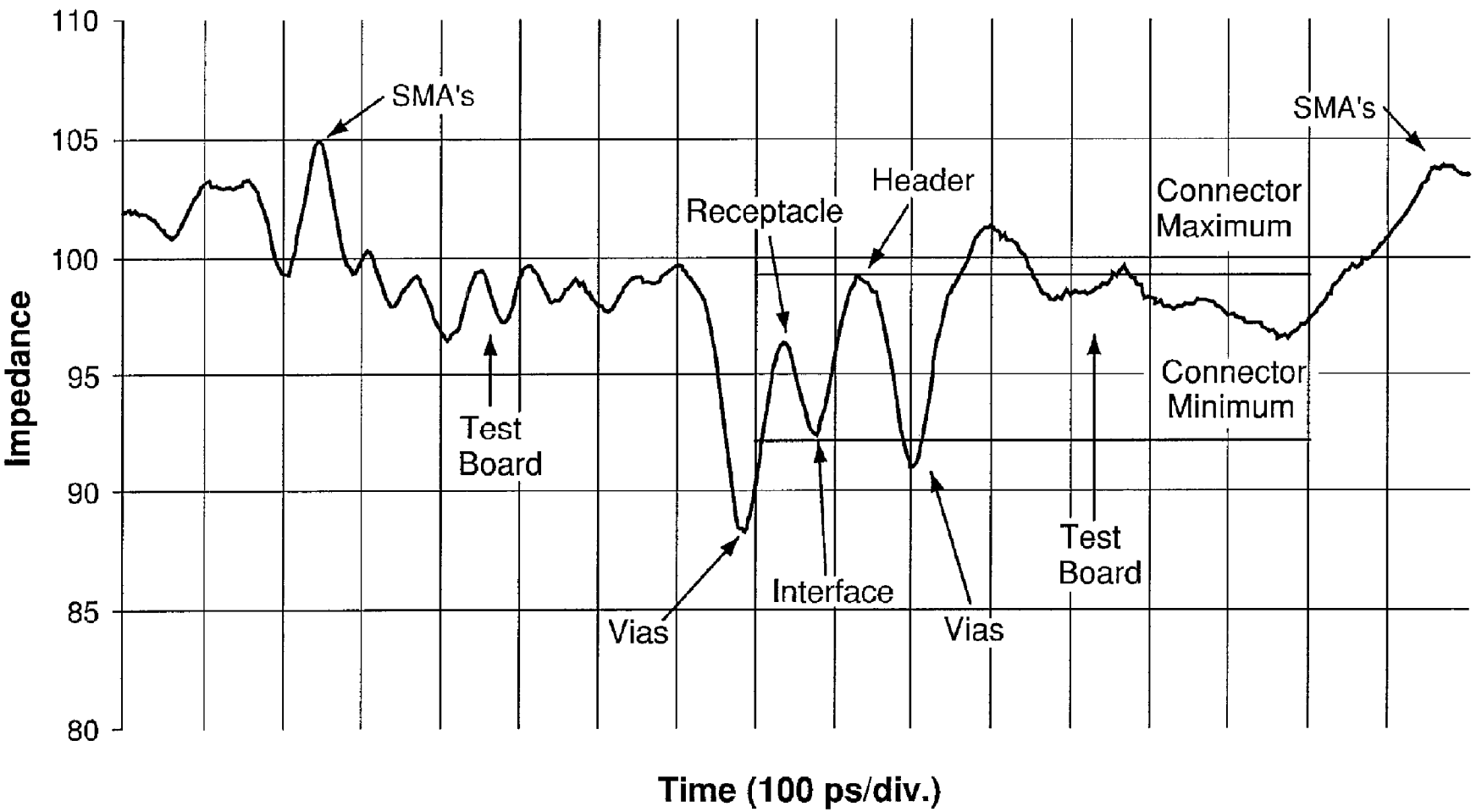
FIG. 1B is a reflection plot of differential impedance as a function of signal propagation time.
Figure 8:
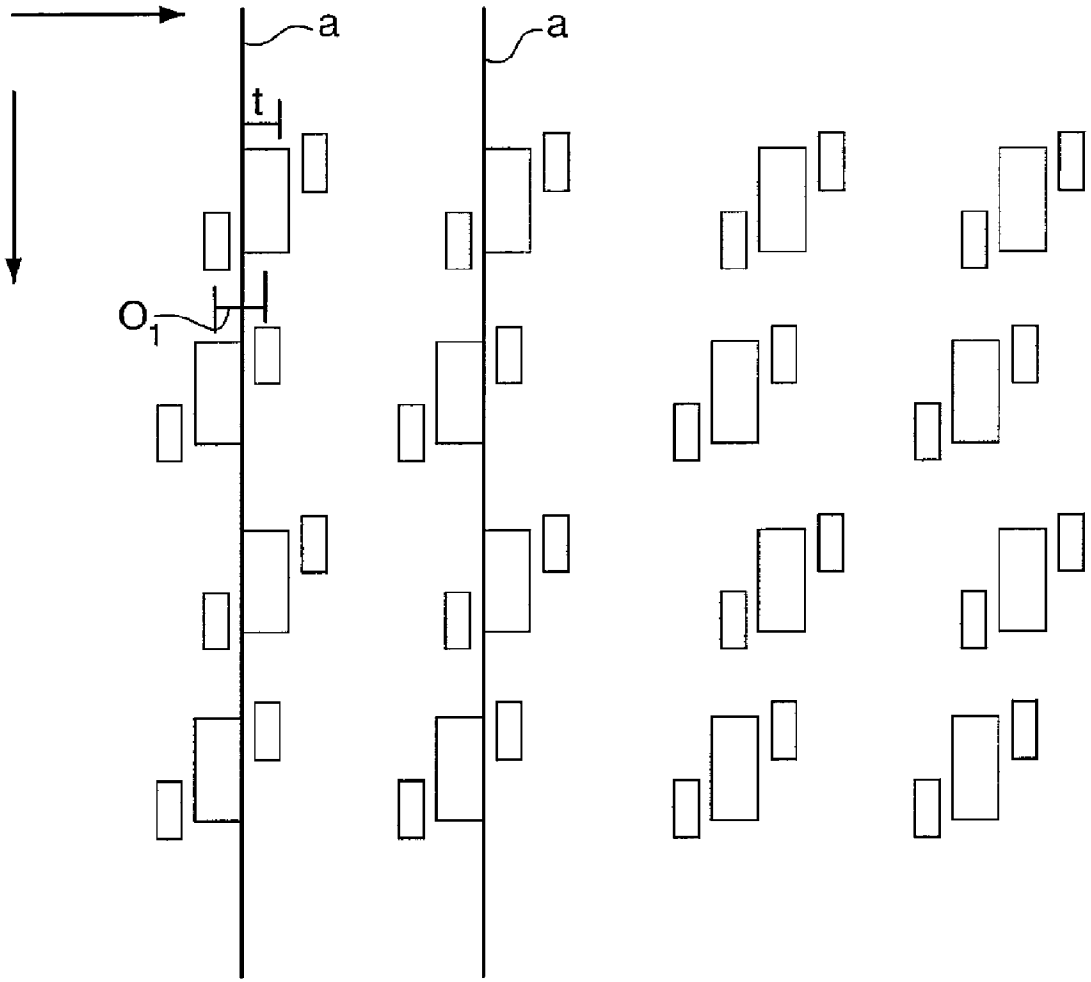
FIGS. 8-13 depict example contact configurations according to the invention for adjusting impedance characteristics of an electrical connector.

Though a connector having a contact arrangement such as shown in FIG. 6 is within acceptable standards (see FIG. 1B, for example), it has been discovered that a contact configuration such as that depicted in FIG. 8 increases the impedance characteristics of such a connector by approximately 6.0 Ω. That is, the differential impedance of a connector with a contact configuration as shown in FIG. 8 (with contact dimensions that are approximately the same as those shown in FIG. 7) is approximately 115.0 Ω. Such a contact configuration helps elevate the impedance in the header/receptacle interface area of the connector by interrupting the edge coupling between adjacent contacts.

FIG. 8 depicts a contact configuration wherein adjacent contacts in a contact set are staggered relative to one another. As shown, the contact set extends generally along a first direction (e.g., a contact column). Adjacent contacts are staggered relative to one another in a second direction relative to the centerline a of the contact set (i.e., in a direction perpendicular to the direction along which the contact set extends). Thus, as shown in FIG. 8, the contact rows may be staggered relative to one another by an offset $o_1$, with each contact center being offset from the centerline a by about $o_1/2$.

Impedance drop may be minimized by aligning the edges of the contacts, that is, staggering the contacts by an offset equal to the contact thickness t. In an example embodiment, t may be approximately 2.1 mm. Though the contacts depicted in FIG. 8 are staggered relative to one another by an offset equal to one contact thickness (i.e., by $o_1$=t), it should be understood that the offset may be chosen to achieve a desired impedance level. Further, though the offset depicted in FIG. 8 is the same for all contacts, it should be understood that the offset could be chosen independently for any pair of adjacent contacts.

Preferably, the contacts are arranged such that each contact column is disposed in a respective IMLA. Accordingly, the contacts may be made to jog away from a contact column centerline a (which may or may not be collinear with the centerline of the IMLA). Preferably, the contacts are "misaligned," as shown in FIG. 8, only in the mating interface region. That is, the contacts preferably extend through the connector such that the terminal ends that mate with a board or another connector are not misaligned.

Figure 9:
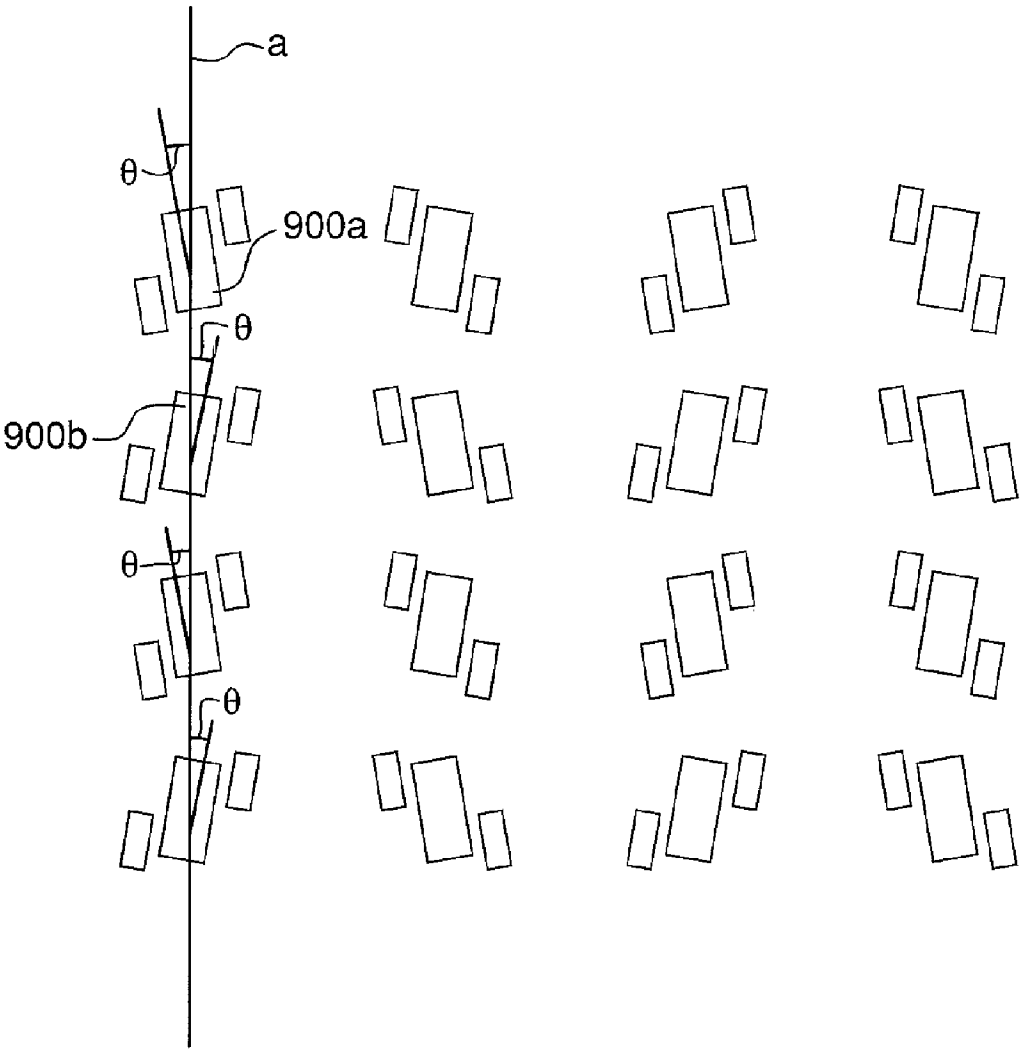

FIG. 9 depicts a contact configuration wherein adjacent contacts 900*a* and 900*b* in a contact set are twisted or rotated in the mating interface region. Twisting or rotating the contact in the mating interface region may reduce differential impedance of a connector. Such reduction may be desirable when matching impedance of a device to a connector to prevent signal reflection, a problem that may be magnified at higher data rates. As shown, the contact set extends generally along a first direction (e.g., along centerline a, such that centerline a extends through a center of each contact, as shown), thus forming a contact column, for example, as shown, or a contact row. Each contact 900*a* and 900*b* may be rotated or twisted relative to the centerline a of the contact set such that, in the mating interface region, it forms a respective angle θ with the contact column centerline a. In an example embodiment of a contact configuration as shown in FIG. 9, the angle θ may be approximately 10°. The angle θ may be any non-zero and non-180 degree angle. Impedance may be reduced by rotating each contact 900*a* and 900*b*, as shown, such that adjacent contacts 900*a* and 900*b* are rotated in opposing directions and all contacts 900*a* and 900*b* form the same (absolute) angle with the centerline. The differential impedance in a connector with such a configuration may be approximately 108.7 Ω, or 0.3 Ω less than a connector in which the contacts are not rotated, such as shown in FIG. 6. It should be understood, however, that the angle to which the contacts 900*a* and 900*b* are rotated may be chosen to achieve a desired impedance level. Further, though the angles depicted in FIG. 9 are the same for all contacts 900*a* and 900*b*, it should be understood that the angles could be chosen independently for each contact 900*a* and 900*b*.

Preferably, the contacts are arranged such that each contact column is disposed in a respective IMLA. Preferably, the contacts are rotated or twisted only in the mating interface region. That is, the contacts preferably extend through the connector such that the terminal ends that mate with a board or another connector are not rotated.

Figure 10:
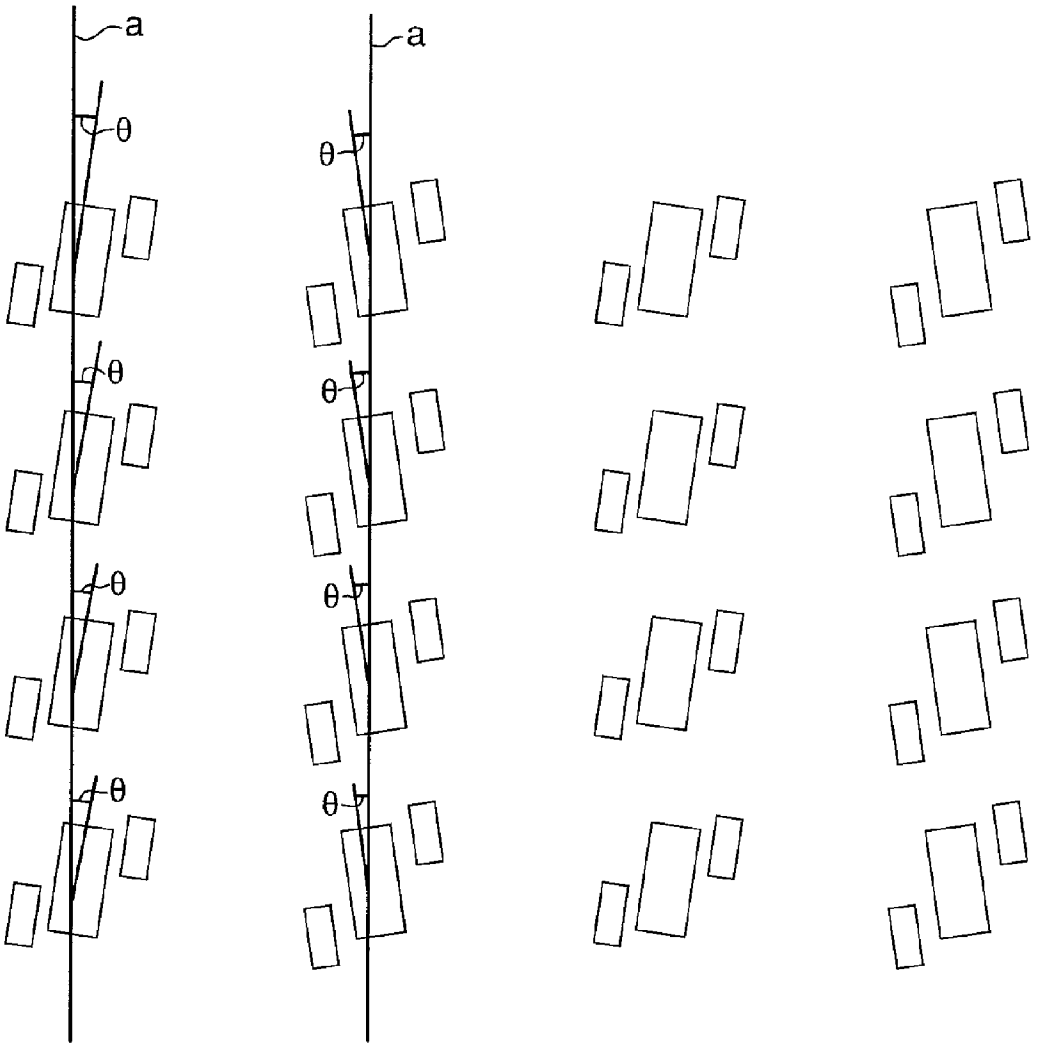

FIG. 10 depicts a contact configuration wherein adjacent contacts in a contact set are twisted or rotated in the mating interface region. By contrast with FIG. 9, however, each set of contacts depicted in FIG. 10 is shown twisted or rotated in the same direction relative to the centerline a of the contact set. Such a configuration may lower impedance more than the configuration of FIG. 9, offering an alternative way that connector impedance may be fine-tuned to match an impedance of a device.

As shown, each contact set extends generally along a first direction (e.g., along centerline a, as shown), thus forming a contact column, for example, as shown, or a contact row. Each contact may be rotated or twisted such that it forms a respective angle θ with the contact column centerline a in the mating interface region. In an example embodiment, the angle θ may be approximately 10°. The differential impedance in a connector with such a configuration may be approximately 104.2 Ω, or 4.8 Ω less than in a connector in which the contacts are not rotated, as shown in FIG. 6, and approximately 4.5 Ω less than a connector in which adjacent contacts are rotated in opposing directions, as shown in FIG. 9.

It should be understood that the angle to which the contacts are rotated may be chosen to achieve a desired impedance level. Further, though the angles depicted in FIG. 10 are the same for all contacts, it should be understood that the angles could be chosen independently for each contact. Also, though the contacts in adjacent contact columns are depicted as being rotated in opposite directions relative to their respective centerlines, it should be understood that adjacent contact sets may be rotated in the same or different directions relative to their respective centerlines a.

Figure 11:
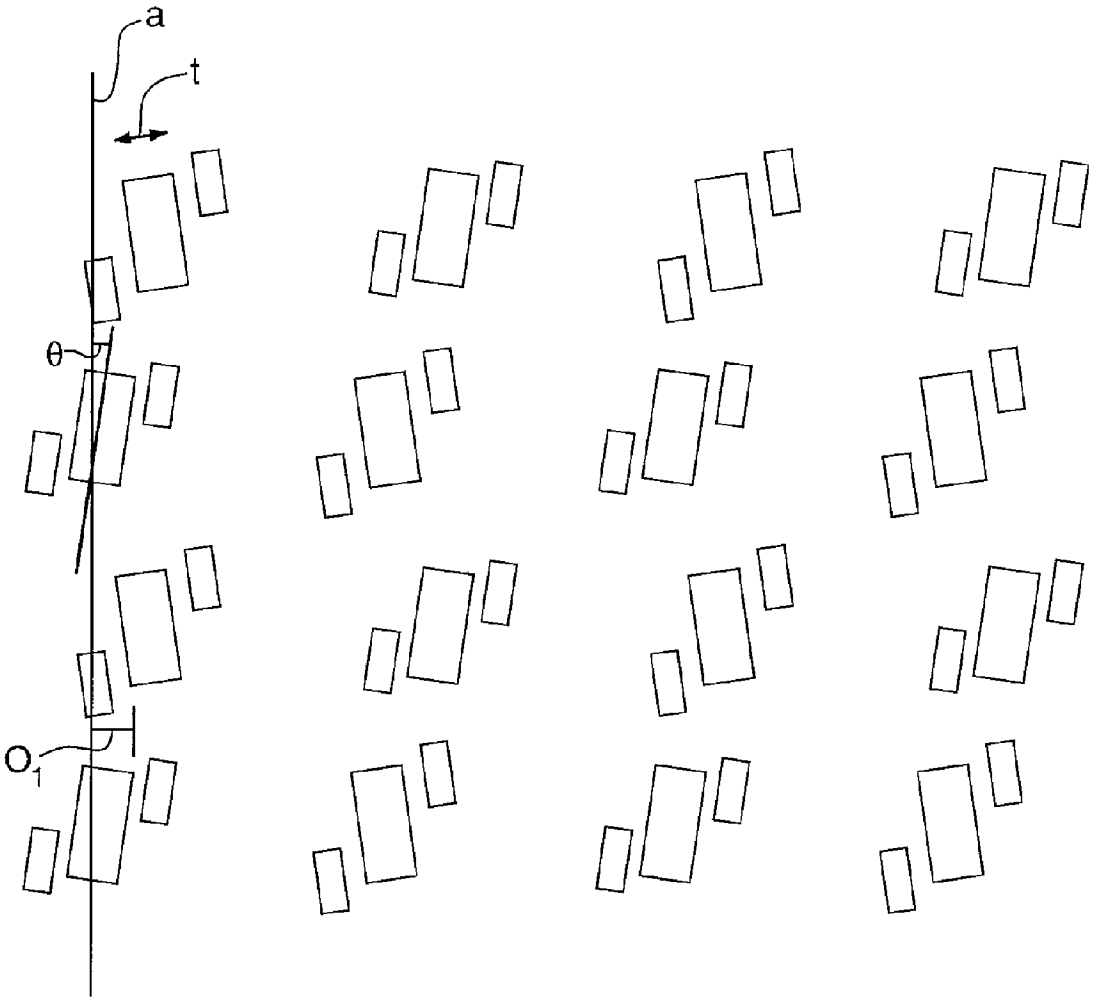

FIG. 11 depicts a contact configuration wherein adjacent contacts within a set are rotated in opposite directions and are staggered relative to one another. Each contact set may extend generally along a first direction (e.g., along centerline a, as shown), thus forming a contact column, for example, as shown, or a contact row. Within each column, adjacent contacts may be staggered relative to one another in a second direction (e.g., in the direction perpendicular to the direction along which the contact set extends). As shown in FIG. 11, adjacent contacts may be staggered relative to one another by an offset $o_1$. Thus, it may be said that adjacent contact rows are staggered relative to one another by an offset $o_1$. In an example embodiment, the offset $o_1$ may be equal to the contact thickness t, which may be approximately 2.1 mm, for example.

Additionally, each contact may be rotated or twisted in the mating interface region such that it forms a respective angle θ with the contact column centerline. Adjacent contacts may be rotated in opposing directions, and all contacts form the same (absolute) angle with the centerline, which may be 10°, for example. The differential impedance in a connector with such a configuration may be approximately 114.8 Ω.

Figure 12:
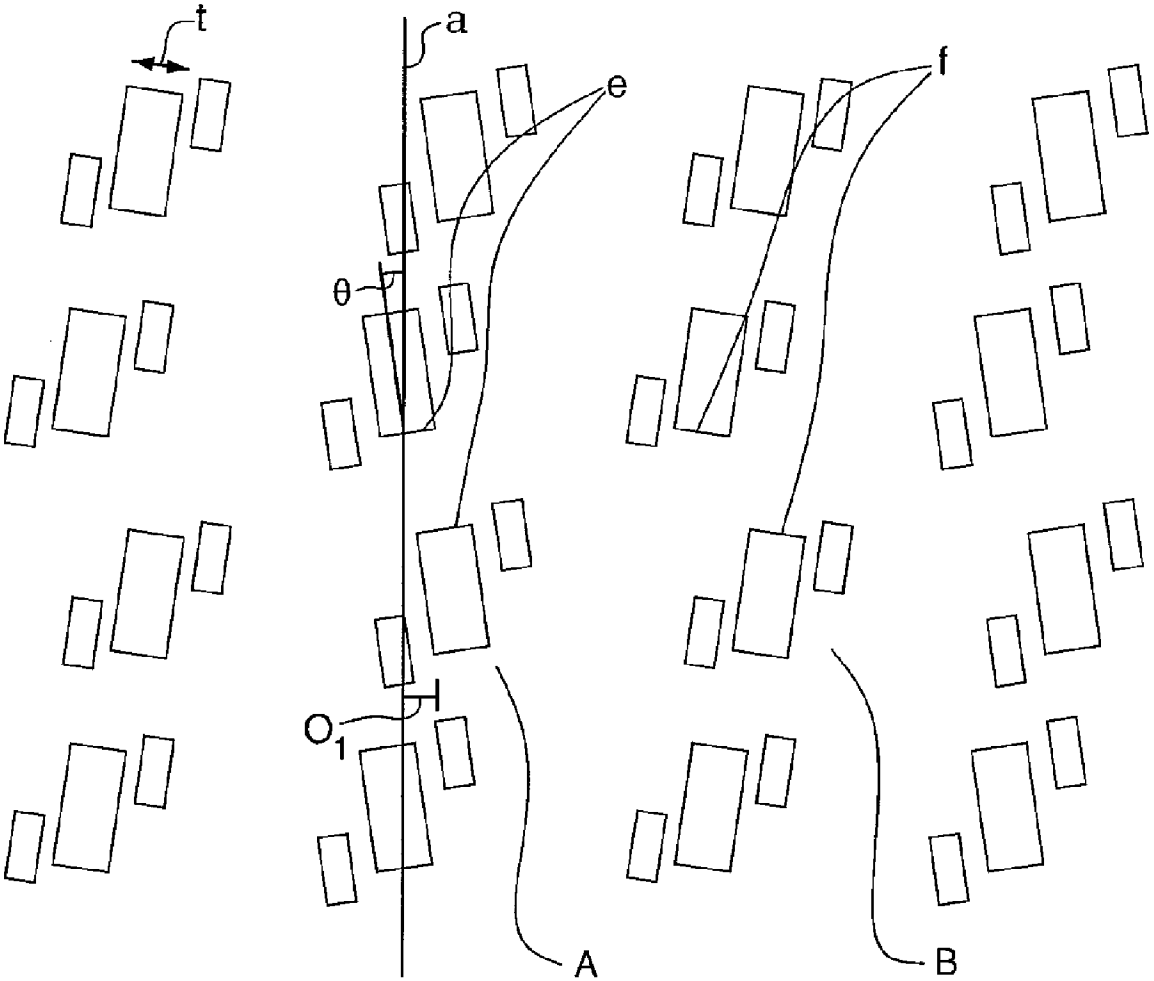

FIG. 12 depicts a contact configuration in which the contacts have been both rotated and staggered relative to one another. Each contact set may extend generally along a first direction (e.g., along centerline a, as shown), thus forming a contact column, for example, as shown, or a contact row. Adjacent contacts within a column may be rotated in the same direction relative to the centerline a of their respective columns. Also, adjacent contacts may be staggered relative to one another in a second direction (e.g., in the direction perpendicular to the direction along which the contact set extends). Thus, contact rows may be staggered relative to one another by an offset $o_1$, which may be, for example, equal to the contact thickness t. In an example embodiment, contact thickness t may be approximately 2.1 mm. Each contact may also be rotated or twisted such that it forms a respective angle with the contact column centerline in the mating interface region. In an example embodiment, the angle of rotation θ may be approximately 10°.

In the embodiment shown in FIG. 12, the differential impedance in the connector may vary between contact pairs. For example, contact pair A may have a differential impedance of 110.8 Ω, whereas contact pair B may have a differential impedance of 118.3 Ω. The varying impedance between contact pairs may be attributable to the orientation of the contacts in the contact pairs. In contact pair A, the twisting of the contacts may reduce the effects of the offset because the contacts largely remain edge-coupled. That is, edges e of the contacts in contact pair A remain facing each other. In contrast, edges f of the contacts of contact pair B may be such that edge coupling is limited. For contact pair B, the twisting of the contacts in addition to the offset may reduce the edge coupling more than would be the case if staggering the contacts without twisting.

Figure 13:
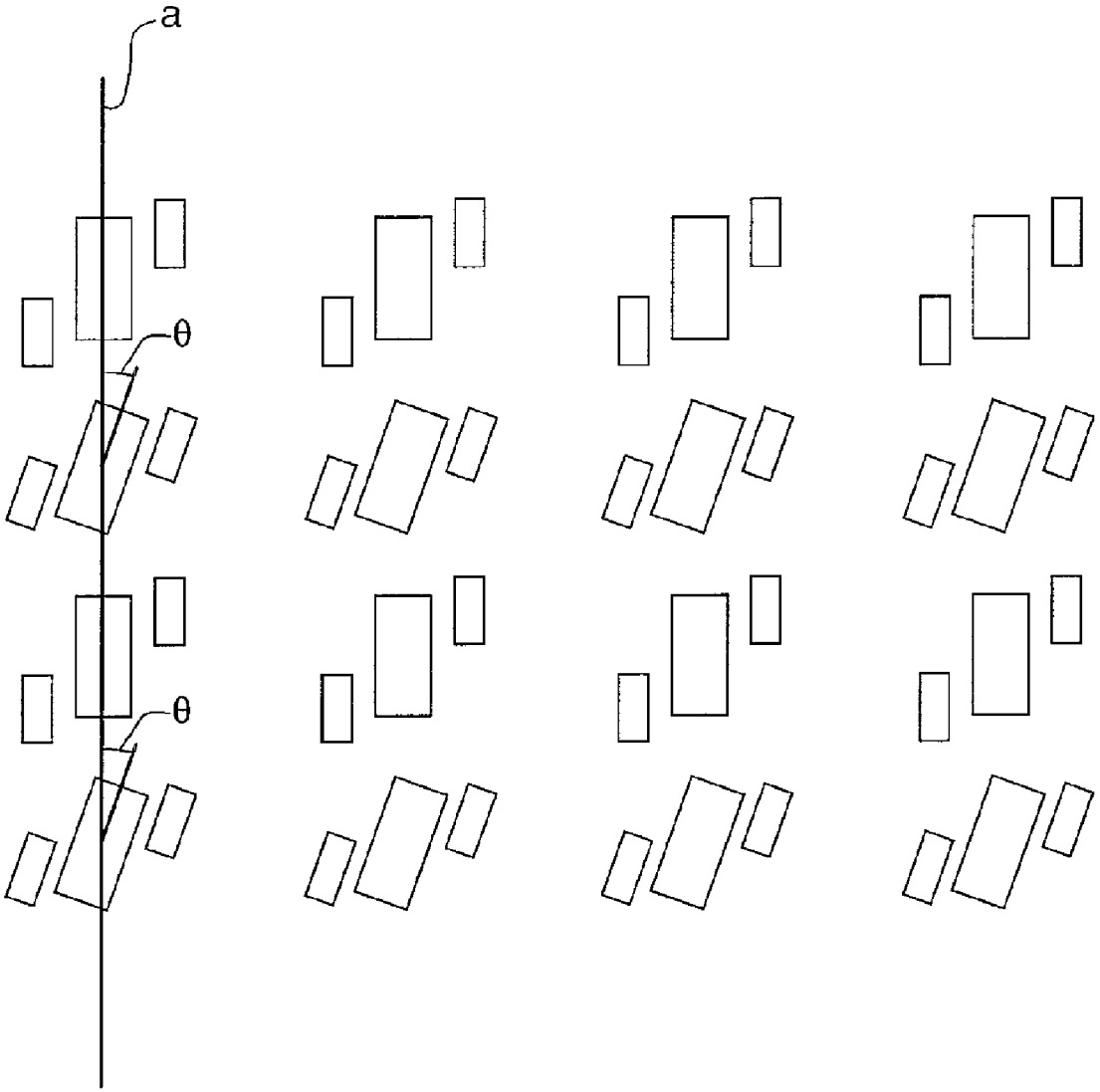

In the embodiment shown in FIG. 13, alternating contacts in a column may be rotated to form an angle of θ with a centerline a of the contact column. The remaining contacts in the column may be positioned at 0° to the centerline a.

Also, it is known that decreasing impedance (by rotating contacts as shown in FIGS. 9 & 10, for example) increases capacitance. Similarly, decreasing capacitance (by moving the contacts out of alignment as shown in FIG. 8, for example) increases impedance. Thus, the invention provides an approach for adjusting impedance and capacitance, in a controlled manner, to a target level.

It should be understood that even though numerous characteristics and advantages of the present invention have been set forth in the foregoing description, the disclosure is illustrative only and changes may be made in detail within the principles of the invention to the full extent indicated by the broad general meaning of the terms in which appended claims are expressed. For example, the dimensions of the contacts and contact configurations in FIGS. 6-12 are provided for example purposes, and other dimensions and configurations may be used to achieve a desired impedance or capacitance. Additionally, the invention may be used in other connectors besides those depicted in the detailed description.

What is claimed:

1. An electrical connector, comprising:

a first electrically conductive contact defining a first center;

a second electrically conductive contact defining a second center, the second contact disposed adjacent to the first contact along a first direction; and a third electrically conductive contact defining a third center, the third contact disposed adjacent to the second contact along the first direction, wherein (i) the centers of the first, second and third contacts are aligned along the first direction such that the first, second and third centers define an imaginary centerline along the first direction, (ii) a mating end of the first contact is positioned at a first non-zero and non-180 degree acute angle relative to the imaginary centerline, a mating end of the second contact is positioned at a second non-zero and non-180 degree acute angle relative to the imaginary centerline, and (iii) the first and second angles are different.

2. The electrical connector of claim 1, wherein the mating end of the first contact is positioned in a first rotational direction relative to the first direction, and the mating end of the second contact is positioned in a second rotational direction relative to the first direction, and wherein the first and the second rotational directions are different.

3. The electrical connector of claim 1, wherein the mating end of at least one of the first and second contacts is positioned at an angle relative to the first direction for achieving a prescribed impedance in the connector.

4. The electrical connector of claim 1, wherein the mating end of at least one of the first and second contacts is positioned at an angle relative to the first direction for achieving a prescribed capacitance in the connector.

5. The electrical connector of claim 1, wherein the first and second contacts have terminal ends, and wherein the terminal ends of the first and second contacts are not rotated.

6. The electrical connector of claim 1, wherein the contacts are disposed in an insert molded lead frame assembly.

7. The electrical connector of claim 1, wherein at least one of the first and second contacts is a single ended signal conductor.

8. The electrical connector of claim 1, wherein the first and second contacts form a differential signal pair.

9. The electrical connector of claim 1, wherein the electrical connector is a header connector or a receptacle connector.

10. The electrical connector of claim 1, wherein the respective mating ends of the first and second contacts are positioned in a first rotational direction relative to the first direction.

11. An electrical connector, comprising:

a plurality of lead frames, each said lead frame comprising a respective column of contacts comprising at least a first contact, a second contact and a third contact, wherein a first column of contacts of a first lead frame of the plurality of lead frames extends along a first direction and defines a centerline extending through a respective center of each contact of the first column of contacts, wherein a mating end of the first contact of the first column of contacts is positioned at a first acute angle relative to the centerline, a mating end of the second contact of the first column of contacts is positioned adjacent to the mating end of the first contact at a second acute angle relative to the centerline wherein the first and second angles are different.

12. The electrical connector of claim 11, wherein the second angle is 0 degrees.

13. The electrical connector of claim 11, wherein the mating end of the first contact is positioned in a first rotational direction relative to the respective column, and the mating end of the second contact is positioned in a second rotational direction relative to the respective column, and wherein the first and the second rotational directions are different.

14. The electrical connector of claim 11, wherein the mating end of the first contact is positioned in a first rotational direction relative to the respective column, and the mating end of the second contact is positioned in a second rotational direction relative to the respective column, and wherein the first and the second rotational directions are the same.

15. The electrical connector of claim 11, wherein the first and second contacts have terminal ends, and wherein the terminal ends of the first and second contacts are not rotated.

16. An electrical connector comprising:

a leadframe comprising, a first contact, a second contact and a third contact, each of the first, second and third contacts defining a mating end having a center and a terminal end, wherein the mating ends of the first, second and third contacts form a first array extending along a first direction and defining an imaginary centerline through the centers of the mating ends and the terminal ends of the first second and third contacts form a second array extending in a second direction orthogonal to the first direction, wherein a first mating end of the first contact is positioned at a first acute angle relative to the centerline, and a second mating end of the second contact is positioned at a second acute angle different than the first angle relative to the centerline, and wherein the terminal end of the first contact defines a first center, the terminal end of the second contact defines a second center, and the terminal end of the third contact defines a third center, and wherein the first center is adjacent the second center in the second direction and the second center is adjacent the third center in the second direction.

* * * * *

UNITED STATES PATENT AND TRADEMARK OFFICE

CERTIFICATE OF CORRECTION

PATENT NO. : 7,517,250 B2
APPLICATION NO. : 10/946874
DATED : April 14, 2009
INVENTOR(S) : Hull et al.

It is certified that error appears in the above-identified patent and that said Letters Patent is hereby corrected as shown below:

Title Page; item (56);

Under REFERENCES CITED, U.S. PATENTS, page 2, the following reference should be included:

2002/0098727 2002-07-25 McNamara, et al.

Signed and Sealed this

Twenty-sixth Day of May, 2009

John Doll

JOHN DOLL
*Acting Director of the United States Patent and Trademark Office*